US007238456B2

(12) United States Patent
Bender et al.

(10) Patent No.: US 7,238,456 B2
(45) **Date of Patent: *Jul. 3, 2007**

(54) SILICON-CONTAINING LAYERS FOR ELECTROPHOTOGRAPHIC PHOTORECEPTORS AND METHODS FOR MAKING THE SAME

(75) Inventors: Timothy P Bender, Port Credit (CA); Nan-Xing Hu, Oakville (CA); John F Graham, Oakville (CA); Yvan Gagnon, Mississauga (CA); Jennifer A Coggan, Cambridge (CA)

(73) Assignee: Xerox Corporation, Stamford, CT (US)

( * ) Notice: Subject to any disclaimer, the term of this patent is extended or adjusted under 35 U.S.C. 154(b) by 326 days.

This patent is subject to a terminal disclaimer.

(21) Appl. No.: 10/998,585

(22) Filed: Nov. 30, 2004

(65) Prior Publication Data

US 2006/0115755 A1 Jun. 1, 2006

(51) Int. Cl.
*G03G 7/147* (2006.01)

(52) U.S. Cl. ..... 430/56; 430/66; 430/132; 430/970

(58) Field of Classification Search ..... 430/56, 430/66, 970, 132; 399/159
See application file for complete search history.

(56) References Cited

U.S. PATENT DOCUMENTS

| | | | | |
|---|---|---|---|---|
| 4,265,990 | A | 5/1981 | Stolka et al. | |
| 4,888,375 | A | 12/1989 | Greco et al. | |
| 4,960,810 | A * | 10/1990 | Foster et al. | 524/265 |
| 6,489,069 | B1 * | 12/2002 | Itami et al. | 430/58.2 |
| 6,730,448 | B2 | 5/2004 | Yoshino et al. | |
| 2004/0086794 | A1 | 5/2004 | Yamada et al. | |

FOREIGN PATENT DOCUMENTS

| | | | |
|---|---|---|---|
| IT | 01315245 | | 10/1999 |
| JP | 57-128344 | A | 8/1982 |
| JP | 60-22347 | B2 | 6/1985 |
| JP | 63-065449 | A | 3/1988 |
| JP | 04-015659 | A | 1/1992 |
| JP | 5-47104 | B2 | 7/1993 |

* cited by examiner

*Primary Examiner*—John L Goodrow
(74) *Attorney, Agent, or Firm*—Oliff & Berridge, PLC

(57) ABSTRACT

Silicon-containing layers for electrophotographic photoreceptors which have high mechanical strength, improved electrophotographic characteristics and improved image deletion characteristics even under conditions of high temperature and high humidity are provided. Such silicon-containing layers include silicon-containing compounds, which may be cross-linked, and siloxane-containing antioxidants that can be selected from hindered phenol antioxidants, hindered amine antioxidants, thioether antioxidants and phosphite antioxidants. Electrophotographic photoreceptors and electrophotographic imaging apparatuses containing such silicon-containing layers are also provided.

10 Claims, 7 Drawing Sheets

SILICON-CONTAINING LAYERS FOR ELECTROPHOTOGRAPHIC PHOTORECEPTORS AND METHODS FOR MAKING THE SAME

BACKGROUND

In electrophotography, an electrophotographic substrate containing a photoconductive insulating layer on a conductive layer is imaged by first uniformly electrostatically charging a surface of the substrate. The substrate is then exposed to a pattern of activating electromagnetic radiation, such as, for example, light. The light or other electromagnetic radiation selectively dissipates the charge in illuminated areas of the photoconductive insulating layer while leaving behind an electrostatic latent image in non-illuminated areas of the photoconductive insulating layer. This electrostatic latent image is then developed to form a visible image by depositing finely divided electroscopic marking particles on the surface of the photoconductive insulating layer. The resulting visible image is then transferred from the electrophotographic substrate to a necessary member, such as, for example, an intermediate transfer member or a print substrate, such as paper. This image developing process can be repeated as many times as necessary with reusable photoconductive insulating layers.

Image forming apparatus such as copiers, printers and facsimiles, including electrophotographic systems for charging, exposure, development, transfer, etc., using electrophotographic photoreceptors have been widely employed. In such image forming apparatus, there are ever increasing demands for improving the speed of the image formation processes, improving image quality, miniaturizing and prolonging the life of the apparatus, reducing production and running costs, etc. Further, with recent advances in computers and communication technology, digital systems and color image output systems have been applied also to image forming apparatus.

Electrophotographic imaging members (i.e. photoreceptors) are well known. Electrophotographic imaging members having either a flexible belt or a rigid drum configuration are commonly used in electrophotographic processes. Electrophotographic imaging members may comprise a photoconductive layer including a single layer or composite layers. These electrophotographic imaging members take many different forms. For example, layered photoresponsive imaging members are known in the art. U.S. Pat. No. 4,265,990 to Stolka et al., which is incorporated herein by reference in its entirety, describes a layered photoreceptor having separate photogenerating and charge transport layers. The photogenerating layer disclosed in the 990 patent is capable of photogenerating holes and injecting the photogenerated holes into the charge transport layer. Thus, in the photoreceptors of the 990 patent, the photogenerating material generates electrons and holes when subjected to light.

More advanced photoconductive photoreceptors containing highly specialized component layers are also known. For example, multilayered photoreceptors may include one or more of a substrate, an undercoating layer, an intermediate layer, an optional hole or charge blocking layer, a charge generating layer (including a photogenerating material in a binder) over an undercoating layer and/or a blocking layer, and a charge transport layer (including a charge transport material in a binder). Additional layers, such as one or more overcoat layer or layers, may be included as well.

In view of such a background, improvement in electrophotographic properties and durability, miniaturization, reduction in cost, etc., in electrophotographic photoreceptors have been studied, and electrophotographic photoreceptors using various materials have been proposed.

For example, JP-A-63-65449 (the term "JP-A" as used herein means an "unexamined published Japanese patent application"), which is incorporated herein by reference in its entirety, discloses an electrophotographic photoreceptor in which fine silicone particles are added to a photosensitive layer, and also discloses that such addition of the fine silicone particles imparts lubricity to a surface of the photoreceptor.

Further, in forming a photosensitive layer, a method has been proposed in which a charge transfer substance is dispersed in a binder polymer or a polymer precursor thereof, and then the binder polymer or the polymer precursor thereof is cured. JP-B-5-47104 (the term "JP-B" as used herein means an "examined Japanese patent publication") and JP-B-60-22347, which are incorporated herein by reference in their entirety, disclose electrophotographic photoreceptors using silicone materials as the binder polymers or the polymer precursors thereof.

Furthermore, in order to improve mechanical strength of the electrophotographic photoreceptor, a protective layer is formed on the surface of the photosensitive layer in some cases. Often, a crosslinkable resin is used as a material for the protective layer. However, protective layers formed by crosslinkable resin act as insulating layers, which impair the photoelectric characteristics of the photoreceptor. For this reason, a method of dispersing a fine conductive metal oxide powder (JP-A-57-128344) or a charge transfer substance (JP-A-4-15659) in the protective layer and a method of reacting a charge transfer substance having a reactive functional group with a thermoplastic resin to form the protective layer have been proposed. JP-A-57-128344 and JP-A-4-15659 are incorporated herein by reference in their entirety.

However, even the above-mentioned conventional electrophotographic photoreceptors are not necessarily sufficient in electrophotographic characteristics and durability, particularly when they are used in combination with a charger of the contact charging system (contact charger) or a cleaning apparatus, such as a cleaning blade.

Further, when the photoreceptor is used in combination with the contact charger and a toner obtained by chemical polymerization (polymerization toner), image quality may be deteriorated due to a surface of the photoreceptor being stained with a discharge product produced in contact charging or the polymerization toner remaining after a transfer step. Still further, the use of a cleaning blade to remove discharge product or remaining toner from the surface of the photoreceptor involves friction and abrasion between the surface of the photoreceptor and the cleaning blade, which tends to damage the surface of the photoreceptor, breaks the cleaning blade or turns up the cleaning blade.

The use of silicon-containing compounds in photoreceptor layers, including in photosensitive and protective layers, has been shown to increase the mechanical lifetime of electrophotographic photoreceptors, under charging conditions and scorotron charging conditions. For example, U.S. Patent Application Publication US 2004/0086794 to Yamada et al., which is incorporated herein by reference in its entirety, discloses a photoreceptor having improved mechanical strength and stain resistance.

Photoreceptors having low wear rates, such as those described in US 2004/0086794, also have low refresh rates. Low wear and refresh rates are a primary cause of image deletion errors, particularly under conditions of high humidity and high temperature. U.S. Pat. No. 6,730,448 B2 to Yoshino et al., which is incorporated herein by reference in its entirety, addresses this issue in its disclosure of photoreceptors having some improvement in image quality, fixing ability, even in an environment of high heat and humidity.

It has been determined that, in electrophotographic photoreceptors, deletion of a developed image is the result of degradation of the top-most surface of the electrophotographic photoreceptor. This deletion occurs when the electrophotographic photoreceptor is exposed to environmental contaminants, such as those typically found around the charging device of a xerographic engine. The image deletion increases under conditions of high heat and high humidity.

In typical electrophotographic photoreceptors, where the outermost surface comprises a solid state solution of a hole-transporting arylamine compound in a polymeric binder material, image deletion occurs when the environmental contaminants around the charging device react with hole-transporting arylamine compounds to form highly conductive species.

However, in electrophotographic photoreceptors in which the outermost layer is a siloxane-organic hybrid material containing a hole-transporting arylamine moiety, image deletion occurs when the environmental contaminants around the charging device in the xerographic engine interact with the siloxane component of the siloxane-organic hybrid material. A chemical reaction by which residual alkoxides of the siloxane components hydrolyze to form highly polar silanol moieties results from this interaction. These highly polar silanols, which reside on the outermost surface of the electrophotographic photoreceptor and both attract and retain environmental contaminants formed by the charging device, which cause highly conductive zones to form on the surface of the electrophotographic photoreceptor. In the presence of high heat and/or high humidity, these highly conductive zones manifest as a deletion of the developed image.

Thus, the above-mentioned conventional electrophotographic photoreceptors are not necessarily sufficient in electrophotographic characteristics and durability, particularly when used in high heat and/or high humidity environments.

Thus, there still remains a need for electrophotographic photoreceptors having high mechanical strength and improved electrophotographic characteristics and improved image deletion characteristics even under conditions of high temperature and high humidity. In particular, there remains a need for an additive to siloxane-containing layers that will interact with the environmental contaminants formed by the charging device of the xerographic engine and prevent the contaminants from interacting with siloxanes residues and that will also prevent or decrease the deletion of developed images.

SUMMARY

Silicon-containing layers for electrophotographic photoreceptors, in which the silicon-containing layers have high mechanical strength, improved electrophotographic characteristics and improved image deletion characteristics even under conditions of high temperature and high humidity are provided.

Separably provided are silicon-containing layers for electrophotographic photoreceptors, in which the silicon-containing layers include silicon-containing compounds and siloxane-containing antioxidants, which are selected from hindered phenol antioxidants, hindered amine antioxidants, thioether antioxidants and phosphite antioxidants.

Separably provided are silicon-containing layers for electrophotographic photoreceptors, in which the silicon-containing layers include silicon-containing compounds and siloxane-containing antioxidants where at least one siloxane-containing antioxidant used in capable of preventing environmental contaminants around the charging device in the xerographic engine from hydrolyzing residual alkoxides of siloxane components of the silicon-containing compound to form highly polar silanol moieties.

Separably provided are silicon-containing layers for electrophotographic photoreceptors, in which the silicon-containing layers include silicon-containing compounds and siloxane-containing antioxidants, where at least one siloxane-containing antioxidant is located at least partially in the siloxane region of the silicon-containing layer.

Separably provided silicon-containing layers for electrophotographic photoreceptors, in which the silicon-containing layers include silicon-containing compounds and siloxane-containing antioxidants, where at least one siloxane-containing antioxidant is covalently bound within the silicon-containing layer.

Separably provided are silicon-containing layers for electrophotographic photoreceptors, in which the silicon-containing layers include silicon-containing compounds and siloxane-containing antioxidants, where at least one siloxane-containing antioxidant is bound to other siloxane units within the silicon-containing layer.

Separably provided are silicon-containing layers for electrophotographic photoreceptors, in which the silicon-containing layers include silicon-containing compounds that are chemically crosslinked.

Separably provided are electrophotographic photoconductors including silicon-containing layers that include silicon-containing compounds and siloxane-containing antioxidants, which are covalently bound within the silicon-containing layer.

Separably provided are electrophotographic photoconductors including silicon-containing layers that include silicon-containing compounds and siloxane-containing antioxidants, which are bound to other siloxane units within the silicon-containing layer.

Separably provided are electrophotographic imaging apparatuses including electrophotographic photoconductors including silicon-containing layers that include silicon-containing compounds that are chemically crosslinked.

Separably provided are electrophotographic imaging apparatuses including such electrophotographic photoreceptors and photoconductors.

These and other features and advantages of various exemplary embodiments of materials, devices, systems and/or methods are described in, or are apparent from, the following detailed description of the various exemplary embodiments of the systems and methods.

DETAILED DESCRIPTION OF PREFERRED EMBODIMENTS

Figure 1:
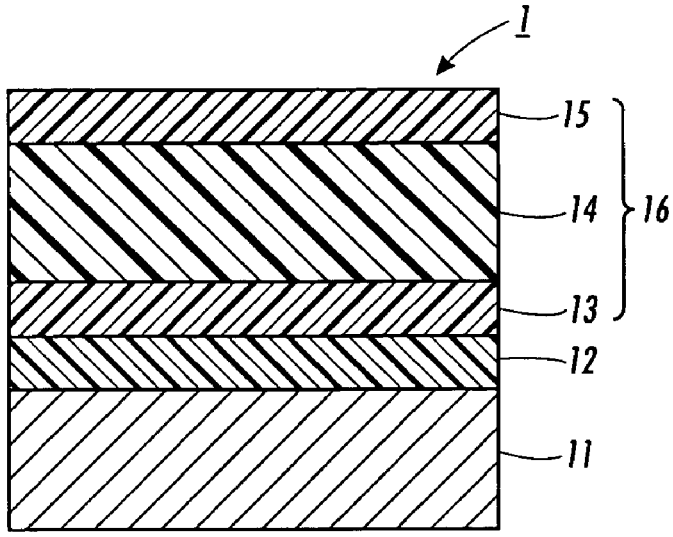
FIG. 1 is a schematic cross-sectional view showing a preferred embodiment of an electrophotographic photoreceptor.

Preferred embodiments will be described in detail below with reference to drawings in some cases. In the drawings, the same reference numerals and signs are used to designate the same or corresponding parts, and repeated descriptions are avoided.

Electrophotographic Photoreceptor

In electrophotographic photoreceptors of embodiments, photosensitive layers may comprise one or more silicon-containing layers, and the silicon-containing layers may further contain resin.

In embodiments, the resin may be a resin soluble in a liquid component in a coating solution used for formation of this layer. Such a liquid-soluble resin may be selected based upon the liquid component employed. For example, if the coating solution contains an alcoholic solvent (such as methanol, ethanol or butanol), a polyvinyl acetal resin such as a polyvinyl butyral resin, a polyvinyl formal resin or a partially acetalized polyvinyl acetal resin in which butyral is partially modified with formal or acetoacetal, a polyamide resin, a cellulose resin such as ethyl cellulose and a phenol resin may be suitably chosen as the alcohol-soluble resins. These resins may be used either alone or as a combination of two or more of them. Of the above-mentioned resins, the polyvinyl acetal resin is used in some embodiments to obtain the benefits of its electric characteristics.

In embodiments, the weight-average molecular weight of the resin soluble in the liquid component may be from 2,000 to 1,000,000, and from 5,000 to 50,000. When the average molecular weight is less than 2,000, the effect of enhancing discharge gas resistance, mechanical strength, scratch resistance, particle dispersibility, etc., tends to become insufficient. However, when the average molecular weight exceeds 1,000,000, the resin solubility in the coating solution decreases, and the amount of resin added to the coating solution may be limited and poor film formation in the production of the photosensitive layer may result.

Further, the amount of resin soluble in the liquid component may be, in embodiments, from 0.1 to 15% by weight, or from 0.5 to 10% by weight, based on the total amount of the coating solution. When the amount added is less than 0.1% by weight, the effect of enhancing discharge gas resistance, mechanical strength, scratch resistance, particle dispersibility, etc., tends to become insufficient. However, if the amount of the resin soluble in the liquid component exceeds 15% by weight, there is a tendency for formation of indistinct images when the electrophotographic photoreceptor of embodiments is used at high temperature and high humidity.

As used herein, a "high temperature environment" or "high temperature conditions" refer to an atmosphere in which the temperature is at least 28° C. A "high humidity environment" or "high humidity conditions" refer to an atmosphere in which the relative humidity is at least 75%.

Silicon-containing compounds used in embodiments, contain at least one silicon atom, but are not particularly limited. However, a compound having two or more silicon atoms in its molecule may be used in embodiments. The use of the compound having two or more silicon atoms in its molecule allows both the strength and image quality of the electrophotographic photoreceptor to be achieved at higher levels.

In embodiments, at least one member selected from silicon-containing compounds represented by the following general formulas (1) to (3) and hydrolysates or hydrolytic condensates thereof may be used.

$$W^1(\text{—}SiR_{3-a}Q_a)_2 \quad (1)$$

$$W^2(\text{—}D\text{—}SiR_{3-a}Q_a)_b \quad (2)$$

$$SiR_{4-c}Q_c \quad (3)$$

In general formulas (1) to (3), $W^1$ represents a divalent organic group, $W^2$ represents an organic group derived from a compound having hole transport capability, Q represents a hydrolytic group, D represents a divalent group, a represents an integer of 1 to 3, b represents an integer of 2 to 4, and c represents an integer of 1 to 4.

R in general formulas (1) to (3) represents a hydrogen atom, an alkyl group such as an alkyl group having 1 to 5 carbon atoms or a substituted or unsubstituted aryl group, such as a substituted or unsubstituted aryl group having 6 to 15 carbon atoms, as described above.

Further, the hydrolytic group represented by Q in general formulas (1) to (3) means a functional group that can form a siloxane bond (O—Si—O) by hydrolysis in the curing reaction of the compound represented by any one of general formulas (1) to (3). Non-limiting examples of hydrolytic groups that may be used in embodiments include a hydroxyl group, an alkoxyl group, a methyl ethyl ketoxime group, a diethylamino group, an acetoxy group, a propenoxy group and a chloro group. In particular embodiments, a group represented by —OR" (R" represents an alkyl group having 1 to 15 carbon atoms or a trimethylsilyl group) may be used.

In general formula (2), the divalent group represented by D may be, in embodiments, a divalent hydrocarbon group represented by $\text{—}C_nH_{2n}\text{—}$, $\text{—}C_nH_{2n-2}\text{—}$, $\text{—}C_nH_{2n-4}\text{—}$ (n is an integer of 1 to 15, and preferably an integer of 2 to 10), $\text{—}CH_2\text{—}C_6H_4\text{—}$ or $\text{—}C_6H_4\text{—}C_6H_4\text{—}$, an oxycarbonyl group (—COO—), a thio group (—S—), an oxy group (—O—), an isocyano group (—N═CH—) or a divalent group in which two or more such groups are combined. The divalent group D may have a substituent group such as an alkyl group, a phenyl group, an alkoxyl group or an amino group on its side chain. When D is one of the above-mentioned divalent groups, proper flexibility may be imparted to an organic silicate skeleton, which improves the strength of the layer.

Non-limiting examples of the compounds represented by the above-mentioned general formula (1) are shown in Table 1.

TABLE 1
| No. | Structural Formula |
|---|---|
| I-1 | $(MeO)_3Si—(CH_2)_2—Si(OMe)_3$ |
| I-2 | $(MeO)_2Me—(CH2)_2—SiMe(OMe)_2$ |
| I-3 | $(MeO)_2MeSi—(CH_2)_6—SiMe(OMe)_2$ |
| I-4 | $MeO)_3Si—(CH_2)_6—Si(OMe)_3$ |
| I-5 | $(EtO)_3Si—(CH_2)_6—Si(OEt)_3$ |
| I-6 | $(MeO)_2MeSi—(CH_2)_{10}—SiMe(OMe)_2$ |
| I-7 | $(MeO)_3Si—(CH_2)_3—NH—(CH_2)_3—Si(OMe)_3$ |
| I-8 | $(MeO)_3Si—(CH_2)_3—NH—(CH_2)_2—NH—(CH_2)_2—Si(OMe)_3$ |
| I-9 | 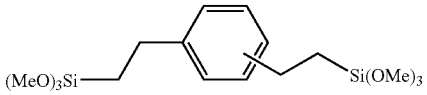 |
| I-10 | 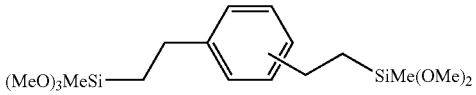 |
| I-11 | 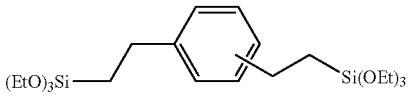 |
| I-12 | 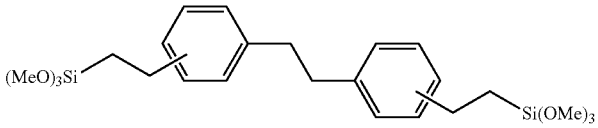 |
| I-13 | 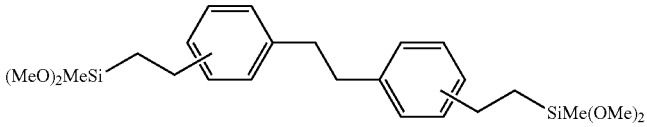 |
| I-14 | 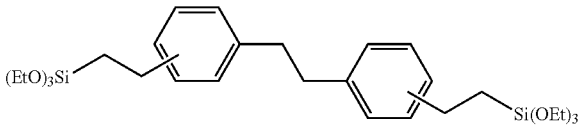 |
| I-15 | $(MeO)_3SiC_3H_6—O—CH_2CH\{—O—C_3H_6Si(OMe)_3\}—CH_2\{—O—C_3H_6Si(OMe)_3\}$ |
| I-16 | $(MeO)_3SiC_2H_4—SiMe_2—O—SiMe_2—O—SiMe_2—C_2H_4Si(OMe)_3$ |

Further, in the above-mentioned general formula (2), there is no particular limitation on the organic group represented by $W^2$, as long as it is a group having hole transport capability. However, in particular embodiments, $W^2$ may be an organic group represented by the following general formula (4):

(4)

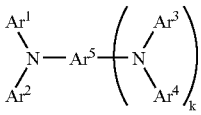

wherein $Ar^1$, $Ar^2$, $Ar^3$ and $Ar^4$, which may be the same or different, each represents a substituted or unsubstituted aryl group, $Ar^5$ represents a substituted or unsubstituted aryl or arylene group, k represents 0 or 1, and at least one of $Ar^1$ to $Ar^5$ may be connected with —D—$SiR_{3-a}Q_a$ in general formula (2).

$Ar^1$ to $Ar^4$ in the above-mentioned general formula (4) are each preferably any one of the following formulas (5) and (6):

(5)

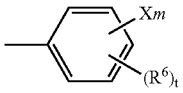

(6)

In formulas (5) and (6), $R^6$ represents a member selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; Ar represents a substituted or unsubstituted arylene group; X represents —D—$SiR_{3-a}Q_a$ in general formula (2); m represents 0 or 1; and t represents an integer of 1 to 3.

Here, Ar in formula (6) may be one represented by the following formula (7) or (8):

(7)

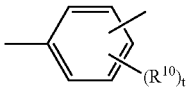

(8)

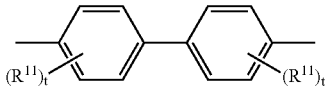

In formulas (7) and (8), $R^{10}$ and $R^{11}$ each represent a member selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; and t represents an integer of 1 to 3.

Further, Z' in formula (6) is preferably one represented by any one of the following formulas (9) to (16):

(9)

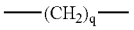

(10)

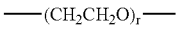

(11)

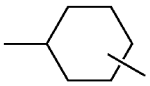

(12)

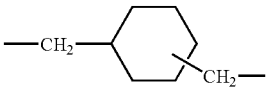

(13)

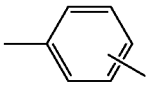

(14)

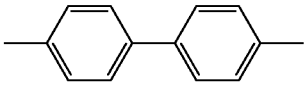

(15)

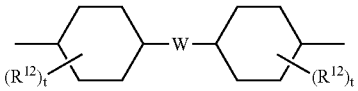

(16)

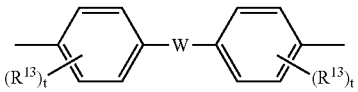

In formulas (9) to (16), $R^{12}$ and $R^{13}$ each represent a member selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; W represents a divalent group; q and r each represents an integer of 1 to 10; and t represents an integer of 1 to 3.

W in the above-mentioned formulas (15) and (16) may be any one of divalent groups represented by the following formulas (17) to (25):

$$—CH_2— \quad (17)$$

$$—C(CH_3)_2— \quad (18)$$

$$—O— \quad (19)$$

$$—S— \quad (20)$$

$$—C(CF_3)_2— \quad (21)$$

$$—Si(CH_3)_2— \quad (22)$$

(23)

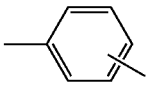

-continued (24)

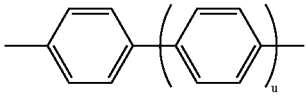

(25)

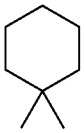

In formula (24), u represents an integer of 0 to 3.

Further, in general formula (5), $Ar^5$ is the aryl group illustrated in the description of $Ar^1$ to $Ar^4$, when k is 0, and an arylene group obtained by removing a certain hydrogen atom from such an aryl group, when k is 1.

Combinations of $Ar^1$, $Ar^2$, $Ar^3$, $Ar^4$, $Ar^5$ and integer k in formula (5) and a group represented by —D—$SiR_{3-a}Q^a$ in general formula (2) in particular exemplary embodiments are shown in Table 2; additional exemplary embodiments can be found in US 2004/0086794 and U.S. Pat. No. 6,730,448 B2. In Table 2, S represents —D—$SiR_{3-a}Q_a$ linked to $Ar^1$ to $Ar^5$, Me represents a methyl group, Et represents an ethyl group, and Pr represents a propyl group.

TABLE 2

| No. | $Ar^1$ | $Ar^2$ | $Ar^3$ & $Ar^4$ | $Ar^5$ | k | —S |
|---|---|---|---|---|---|---|
| II-1 | 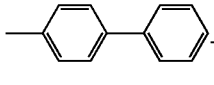 | 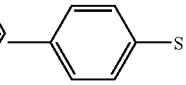 | — | 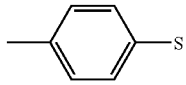 | 0 | —$(CH_2)_2$—COO—$(CH_2)_3$—$Si(O^iPr)_3$ |
| II-2 | 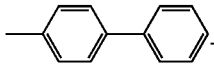 | 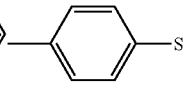 | — | 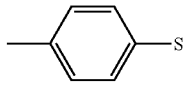 | 0 | —$(CH_2)_2$—COO—$(CH_2)_3$—$SiMe(O^iPr)_2$ |
| II-3 | 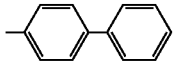 | 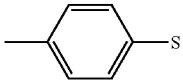 | — | 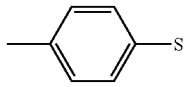 | 0 | —$(CH_2)_2$—COO—$(CH_2)_3$—$SiMe_2(O^iPr)_2$ |
| II-4 | 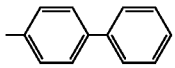 | 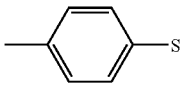 | — | 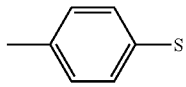 | 0 | —COO—$(CH_2)_3$—$Si(O^iPr)_3$ |
| II-5 | 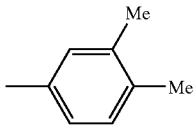 | 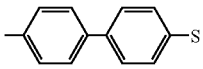 | — | 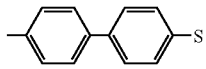 | 0 | —$(CH_2)_2$—COO—$(CH_2)_3$—$Si(O^iPr)_3$ |
| II-6 | 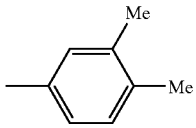 | 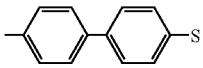 | — | 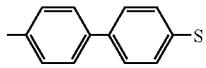 | 0 | —$(CH_2)_2$—COO—$(CH_2)_3$—$SiMe(O^iPr)_2$ |
| II-7 | 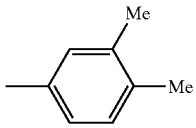 | 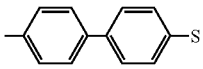 | — | 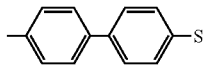 | 0 | —$(CH_2)_2$—COO—$(CH_2)_3$—$SiMe_2(O^iPr)$ |
| II-8 | 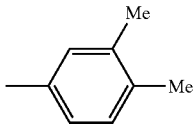 | 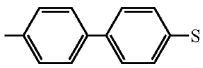 | — | 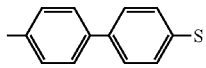 | 0 | —COO—$(CH_2)_3$—$Si(O^iPr)_3$ |
| II-9 | 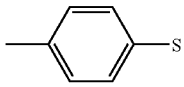 | 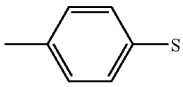 | — | 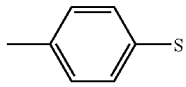 | 0 | —$(CH_2)_2$—COO—$(CH_2)_3$—$Si(O^iPr)_3$ |
| II-10 | 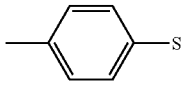 | 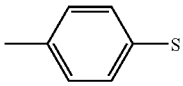 | — | 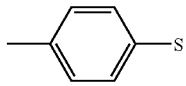 | 0 | —$(CH_2)_2$—COO—$(CH_2)_3$—$SiMe(O^iPr)_2$ |

TABLE 2-continued

| No. | $Ar^1$ | $Ar^2$ | $Ar^3$ & $Ar^4$ | $Ar^5$ | k | —S |
|---|---|---|---|---|---|---|
| II-11 | 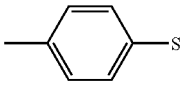 | 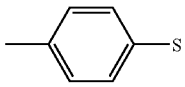 | — | 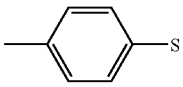 | 0 | —$(CH_2)_2$—COO—$(CH_2)_3$—$SiMe_2(O^iPr)$ |
| II-12 | 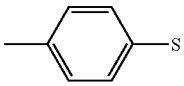 | 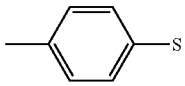 | — | 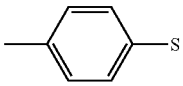 | 0 | —COO—$(CH_2)_3$—$Si(O^iPr)_3$ |
| II-13 | 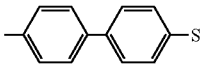 | 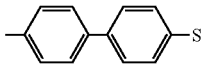 | — | 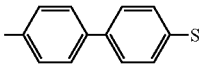 | 0 | —$(CH_2)_2$—COO—$(CH_2)_3$—$Si(O^iPr)_3$ |
| II-14 | 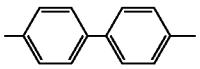 | 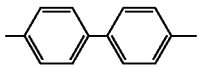 | — | 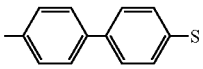 | 0 | —$(CH_2)_2$—COO—$(CH_2)_3$—$SiMe(O^iPr)_2$ |
| II-15 | 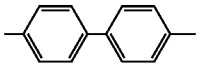 | 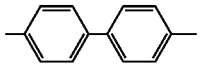 | — | 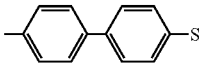 | 0 | —$(CH_2)_2$—COO—$(CH_2)_3$—$SiMe_2(O^iPr)$ |
| II-16 | 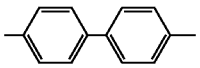 | 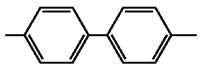 | — | 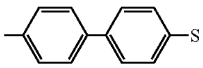 | 0 | —COO—$(CH_2)_3$—$Si(O^iPr)_3$ |

Further, in embodiments, the silicon-containing compounds represented by the above-mentioned general formula (3) may include silane coupling agents, such as a tetrafunctional alkoxysilane (c=4), such as tetramethoxysilane or tetraethoxysilane; a trifunctional alkoxysilane (c=3), such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltriethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, (tridecafluoro-1,1,2,2-tetrahydrooctyl)triethoxysilane, (3,3,3-trifluoropropyl) trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane or 1H,1H,2H,2H-perfluorooctyltriethoxysilane; a bifunctional alkoxysilane (c=2), such as dimethyldimethoxysilane, diphenyldimethoxysilane or methylphenyldimethoxysilane; and a monofunctional alkoxysilane (c=1), such as trimethylmethoxysilane.

In order to improve the strength of the photosensitive layer, the trifunctional alkoxysilanes and the tetrafunctional alkoxysilanes may be used in embodiments, and in order to improve the flexibility and film-forming properties, the monofunctional alkoxysilanes and the bifunctional alkoxysilanes may be used in embodiments.

Silicone hard-coating agents containing such coupling agents can also be used in embodiments. Commercially available hard-coating agents include KP-85, X-40-9740 and X-40-2239 (available from Shinetsu Silicone Co., Ltd.), and AY42-440, AY42-441 and AY49-208 (available from Toray Dow Corning Co., Ltd.).

In embodiments, the silicon-containing layer may contain either only one of the silicon-containing compounds represented by the above-mentioned general formulas (1) to (3) or two or more of them. Further, the compounds represented by general formulas (1) to (3) may include a monofunctional compound (a compound in which a or c is 1), a bifunctional compound (a compound in which a or c is 2), a trifunctional compound (a compound in which a or c is 3) and/or a tetrafunctional compound (a compound in which a or c is 4). However, in particular embodiments, the number of silicon atoms derived from the silicon-containing compounds represented by the above-mentioned general formulas (1) to (3) in the silicon-containing layer satisfies the following equation (26):

$$(N_{a=3}+N_{c\geqq 3})/N_{total}\leqq 0.5 \quad (26)$$

wherein $N_{a=3}$ represents the number of silicon atoms derived from —$SiR_{3-a}Q_a$ of the silicon-containing compound represented by general formula (1) or (2), in which a is 3; $N_{c\geqq 3}$ represents the number of silicon atoms derived from the silicon-containing compound represented by general formula (3) in which c is 3 or 4; and $N_{total}$ represents the total of the number of silicon atoms derived from —$SiR_{3-a}Q_a$ of the silicon compound represented by general formula (1) or (2) and the number of silicon atoms derived from the silicon-containing compound represented by general formula (3). That is to say, the ratio of silicon-containing compounds contained is set so that the number of silicon atoms derived from the trifunctional compound or the tetrafunctional compound becomes 0.5 or less based on the number of silicon atoms derived from the silicon-containing compounds represented by general formulas (1) to (3) (in the case of the compound represented by general formula (1) or (2), the silicon atoms are limited to ones derived from —$SiR_{3-a}Q_a$, and the same applies hereinafter). When the value of the left side of equation (26) exceeds 0.5, an indistinct image tends to be liable to occur at high temperature and high humidity. When the value of the left side of equation (26) is decreased, a decrease in strength may also result. However, the use of a silicon-containing compound having two or more silicon atoms in its molecule can improve the strength.

In order to further improve the stain adhesion resistance and lubricity of embodiments of the electrophotographic photoreceptor, various fine particles can also be added to the silicon-containing layer. Non-limiting examples of the fine particles include fine particles containing silicon, such as fine particles containing silicon as a constituent element, and specifically include colloidal silica and fine silicone particles. Fine particles may be used either alone or as a combination of two or more of such fine particles.

Colloidal silica used in embodiments as the fine particles containing silicon may be selected from acidic or alkaline aqueous dispersions of fine particles having an average particle size of 1 to 100 nm, or 10 to 30 nm, and dispersions of fine particles in organic solvents, such as an alcohol, a ketone or an ester. In general, commercially available particles may be used. There is no particular limitation on the solid content of colloidal silica in a top surface layer of the electrophotographic photoreceptor of embodiments. However, in embodiments, colloidal silica is used within the range of 1 to 50% by weight, or 5 to 30% by weight, based on the total solid content of the top surface layer, in terms of film-forming properties, electric characteristics and strength.

Fine silicone particles that may be used as fine particles containing silicon in embodiments may be selected from silicone resin particles, silicone rubber particles and silica particles surface-treated with silicone. Such particles may be spherical and may have an average particle size of 1 to 500 nm or 10 to 100 nm. In general, commercially available particles may be used in embodiments.

In embodiments, the fine silicone particles are small-sized particles that are chemically inactive and excellent in dispersibility in a resin, and further are low in content as may be necessary for obtaining sufficient characteristics. Accordingly, the surface properties of the electrophotographic photoreceptor can be improved without inhibition of the crosslinking reaction. That is to say, fine silicone particles improve the lubricity and water repellency of surfaces of electrophotographic photoreceptors where incorporated into strong crosslinked structures, which may then be able to maintain good wear resistance and stain adhesion resistance for a long period of time. The content of the fine silicone particles in the silicon-containing layer of embodiments may be within the range of 0.1 to 20% by weight, or within the range of 0.5 to 10% by weight, based on the total solid content of the silicon-containing layer.

Other fine particles that may be used in embodiments include fine fluorine-based particles, such as ethylene tetrafluoride, ethylene trifluoride, propylene hexafluoride, vinyl fluoride and vinylidene fluoride, and semiconductive metal oxides such as ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $In_2O_3$, ZnO and MgO.

In conventional electrophotographic photoreceptors, when the above-mentioned fine particles are contained in the photosensitive layer, the compatibility of the fine particles with a charge transfer substance or a binding resin may become insufficient, causing layer separation in the photosensitive layer, and forming an opaque film. As a result, the electric characteristics may deteriorate. In contrast, the silicon-containing layer of embodiments may contain silicon-containing compounds and resin soluble in the liquid component in the coating solution used for formation of the silicon-containing layer, thereby improving the dispersibility of the fine particles in the silicon-containing layer. Accordingly, the pot life of the coating solution can be sufficiently prolonged, and it becomes possible to prevent deterioration of the electric characteristics.

A siloxane-containing antioxidant is also incorporated into the silicon-containing layer of embodiments. In certain embodiments, the siloxane-containing antioxidant may be wholly or at least partially located in the siloxane region of the silicon-containing layer. The siloxane-containing antioxidants may include any siloxane-containing antioxidant having a hindered phenol, hindered amine, thioether or phosphite partial structure. The use of antioxidants in layers of electrophotographic photoreceptors, in particular to protective layers as described below, is known to help eliminate image deletion errors. In particular, the addition of standard antioxidants such as butylated hydroxy toluene (BHT) is known to improve image deletion. However, image deletion errors in long term cycling under conditions of high humidity and high temperature remain problematic with standard antioxidants. Use of siloxane-containing antioxidants having a hindered phenol, hindered amine, thioether or phosphite partial structure, as described herein, has been surprisingly found to drastically improve image deletion error even in long term cycling under conditions of high humidity and high temperature.

The siloxane-containing antioxidants that may be used in embodiments are structurally related to conventional antioxidants, such as, for example, butylated hydroxytolune (BHT), and contain a siloxane or disiloxane unit. The inclusion of siloxane units in the antioxidant molecules of embodiments allows the antioxidant to be covalently bound within the silicon-containing layer. In addition, siloxane-containing antioxidant molecules may be covalently bound to other siloxane units.

A non-limiting exemplary group of siloxane-containing antioxidants that may be used in embodiments are siloxane-containing hindered-phenol antioxidants structurally related to BHT, such as the siloxane-containing antioxidants that may be represented by general formula (27) below. Other siloxane-containing antioxidants having a hindered phenol, hindered amine, thioether or phosphite partial structure may be easily ascertained by those of skill in the art.

(27)

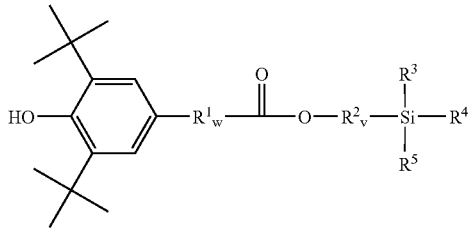

In formula (27), $R^1$ and $R^2$ each represent a divalent hydrocarbon group, such as those represented by —$C_nH_{2n}$—, —$C_nH_{2n-2}$—, —$C_nH_{2n-4}$— (n is an integer of 1 to 18, and, in embodiments, an integer of 2 to 10), —$CH_2$—$C_6H_4$— or —$C_6H_4$—$C_6H_4$—, a thio group (—S—), an oxy group (—O—), any group represented by formulas (9) to (16), or a divalent group in which two or more such groups are combined. $R^1$ and $R^2$ may each have a substituent group, such as an alkyl group, a phenyl group, an alkoxyl group or an amino group on its side chain. Each of w and v in formula (27) represents the number of repeating divalent groups $R^1$ and $R^2$, and can be an integer from 0 to 18. $R^3$, $R^4$ and $R^5$ each represent a member selected from the group consisting of hydrogen atoms, alkyl groups having 1 to 18 carbon atoms and alkoxyl groups having 1 to 18 carbon atoms, with the proviso that at least one of $R^3$, $R^4$ and $R^5$ represents an alkoxyl group and, in embodiments, at least two of $R^3$, $R^4$ and $R^5$ and represented by alkoxy groups. Siloxane-containing antioxidants such as those represented by formula (27) may be prepared, for example, by treating an acid of a hindered phenol compound with a salt and adding a halogenated silane compound. While the composition of a compound of the type of formula 27 has been previously disclosed, for example, in U.S. Pat. No. 4,888,375 and in Italian Patent No. IT 0131245, the conventional preparation methods require numerous steps and is very low yielding, having estimated yields of less than 45%. According to such conventional preparation, 3-(4-hydroxy-3,5-di-t-butylphenyl)propanoic acid is first esterified with allyl alcohol, which is then reacted with a methyldiethoxysilane prepared from dichloromethylsilane and ethyl alcohol, in the presence of a chloroplatinic acid catalyst in toluene at 80° C. to produce the desired compound. The hydrosilylation step has a yield of 73%.

In contrast, the process of embodiments includes synthesis of a compound of the type of formula 27 that requires only two steps and gives a crude yield of 100%, and after purification by vacuum distillation a final yield of 85%, which can be described as follows: 3-(4-hydroxy-3,5-di-t-butylphenyl)propanoic acid is treated with potassium isopropoxide in isopropanol at room temperature for 30 minutes. After removal of the solvent under reduced pressure, the compound is dissolved in DMF and treated with 3-iodopropylmethyldiisopropoxysilane. After heating at 80° C. for two hours, the reaction is cooled and placed into dichloromethane and washed with brine solution. The organic layer is collected and dried. The solvent is removed under reduced pressure, and the compound is purified by vacuum distillation. A total yield of 85% of analytically pure compound of the type that can be represented by formula 27, wherein $R^1$ is —$CH_2CH_2$—, $R^2$ is —$CH_2CH_2CH_2$—, $R^3$ is —$CH_3$, $R^4$ and $R^5$ are —$OiC_3H_7$, can thus be achieved.

The process of embodiments may include synthesis of a compound of the type of formula 27 which can be described as follows: 3-(4-hydroxy-3,5-di-t-butylphenyl)propanoic acid is treated with 1.1 equivalents of potassium carbonate in a mixture of DMF and toluene under reflux, in an apparatus suitable for azeotropic distillation. When no further water was distilled, 1.1 equivalents of 3-iodopropylmethyldiisopropoxy silane is added. The reaction is maintained at 70° C. until no starting material remained. The reaction mixture is then poured into a saturated sodium chloride solution and extracted using toluene. The toluene is removed by rotary extraction. The final product is a yellowish oil obtained by flash column chromatography with toluene followed by vacuum distillation. $^1H$ NMR ($CDCl_3$) can be used to determine the composition of the material as compound III-2, with a purity of up to 98%.

These methods can be summarized in reaction scheme (29):

(29)

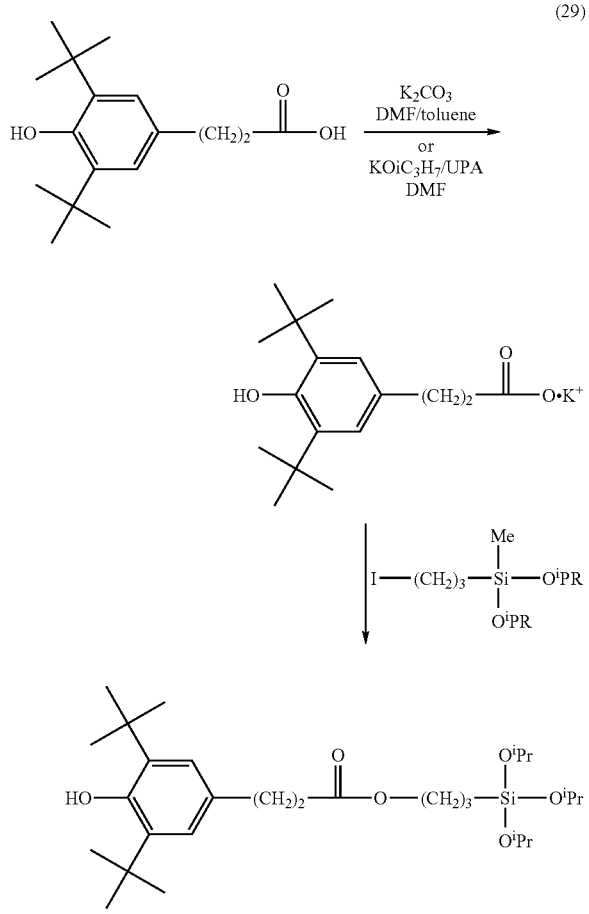

Table 3 sets forth the chemical structure of a conventional antioxidant, BHT, and several non-limiting examples of siloxane-containing antioxidants that are structurally related to BHT and that may be used in embodiments.

TABLE 3

| Antioxidant | Chemical Structure |
|---|---|
| Butylated hydroxyl toluene (BHT) | 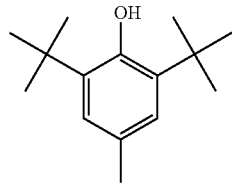 |

TABLE 3-continued

| Antioxidant | Chemical Structure |
|---|---|
| III-1 | 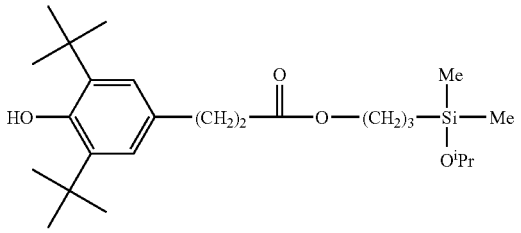 |
| III-2 | 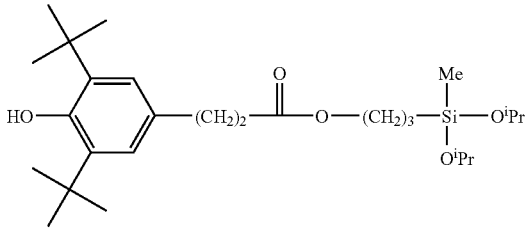 |
| III-3 | 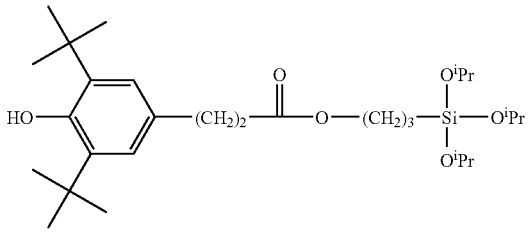 |

Further, an additive such as a plasticizer, a surface modifier or an agent for preventing deterioration by light can also be used in the silicon-containing layer of embodiments. Non-limiting examples of plasticizers that may be used in embodiments include, for example, biphenyl, biphenyl chloride, terphenyl, dibutyl phthalate, diethylene glycol phthalate, dioctyl phthalate, triphenylphosphoric acid, methylnaphthalene, benzophenone, chlorinated paraffin, polypropylene, polystyrene and various fluorohydrocarbons.

There is no particular limitation on the thickness of the silicon-containing layer, however, in embodiments, the silicon-containing layer may be in the range from 2 to 5 μm in thickness or from 2.7 to 3.2 μm in thickness.

In embodiments, the photosensitive layer may comprise the silicon-containing layer as described above. In embodiments, the photosensitive has a peak area in the region of −40 to 0 ppm ($S_1$) and a peak area in the region of −100 to −50 ppm ($S_2$) in a $^{29}$Si—NMR spectrum that satisfy the following equation (1):

$$S_1/(S_1+S_2) \geqq 0.5 \quad (28).$$

When $S_1/(S_1+S_2)$ is less than 0.5, defects are liable to occur. In particular, there is a tendency to cause an indistinct image at high temperature and the pot life shortened. Thus, $S_1/(S_1+S_2)$ may be 0.6 or more, 0.7 or more.

The $^{29}$Si—NMR spectrum of the photosensitive layer can be measured through the following procedure. First, the photosensitive layer is separated from the electrophotographic photoreceptor by use of a silicon-free adhesive tape, and a sample tube (7 mm in diameter) made of zirconia is filled with 150 mg of the resulting separated product. The sample tube is set on a $^{29}$Si—NMR spectral measuring apparatus (for example, UNITY-300 manufactured by Varian, Inc.), and measurements are made under the following conditions:

Frequency: 59.59 MHz
Delay time: 10.00 seconds
Contact time: 2.5 milliseconds
Measuring temperature: 25° C.
Integrating number: 10,000 times
Revolution: 4,000±500 rpm The electrophotographic photoreceptor of embodiments may be either a function-separation-type photoreceptor, in which a layer containing a charge generation substance (charge generation layer) and a layer containing a charge transfer substance (charge transfer layer) are separately provided, or a monolayer-type photoreceptor, in which both the charge generation layer and the charge transfer layer are contained in the same layer, as long as the electophotographic photoreceptor of the particular embodiment has the photosensitive layer provided with the above-mentioned silicon-containing layer. The electrophotographic photoreceptor of embodiments will be described in greater detail below, taking the function-separation-type photoreceptor as an example.

FIG. 1 is a cross-sectional view schematically showing an exemplary embodiment of the electrophotographic photoreceptor. The electrophotographic photoreceptor 1 shown in FIG. 1 is a function-separation-type photoreceptor in which a charge generation layer 13 and a charge transfer layer 14 are separately provided. That is, an underlayer 12, the charge generation layer 13, the charge transfer layer 14 and a protective layer 15 are laminated onto a conductive support 11 to form a photosensitive layer 16. In embodiments, the protective layer 15 contains a resin soluble in the liquid component contained in the coating solution used for formation of this layer, the silicon-containing compound and at least one siloxane-containing antioxidant. Further, a peak area in the region of −40 to 0 ppm and a peak area in the region of −100 to −50 ppm in a $^{29}$Si—NMR spectrum of the photosensitive layer 16 satisfy equation (28).

The conductive support 11 may include, for example, a metal plate, a metal drum or a metal belt using a metal such as aluminum, copper, zinc, stainless steel, chromium, nickel, molybdenum, vanadium, indium, gold or a platinum, or an alloy thereof; and paper or a plastic film or belt coated, deposited or laminated with a conductive polymer, a conductive compound such as indium oxide, a metal such as aluminum, palladium or gold, or an alloy thereof. Further, surface treatment (such as anodic oxidation coating, hot water oxidation, chemical treatment, or coloring) or diffused reflection treatment (such as graining) can also be applied to a surface of the support 11.

Binding resins used in the underlayer 12 of embodiments may include but are not limited to, one or more polyamide resins, vinyl chloride resins, vinyl acetate resins, phenol resins, polyurethane resins, melamine resins, benzoguanamine resins, a polyimide resins, polyethylene resins, polypropylene resins, polycarbonate resins, acrylic resins, methacrylic resins, vinylidene chloride resins, polyvinyl acetal resins, vinyl chloride-vinyl acetate copolymers, polyvinyl alcohol resins, a water-soluble polyester resins, nitrocelluloses, caseins, gelatins, polyglutamic acids, starches, starch acetates, amino starches, polyacrylic acids, polyacrylamides, zirconium chelate compounds, titanyl chelate compounds, titanyl alkoxide compounds, organic titanyl compounds, silane coupling agents and mixtures thereof. Further, fine particles of titanium oxide, aluminum oxide, silicon oxide, zirconium oxide, barium titanate, a silicone resin or the like may be added to the above-mentioned binding resin in embodiments.

As a coating method in forming the underlayer of embodiments, an ordinary method such as blade coating, Mayer bar coating, spray coating, dip coating, bead coating, air knife coating or curtain coating may be employed. The thickness of the underlayer may be from 0.01 to 40 μm.

Non-limiting examples of charge generation substances that may be contained in the charge generation layer 13 of embodiments include, but are not limited to, various organic pigments and organic dyes; such as azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes and cyanine dyes; and inorganic materials such as amorphous silicon, amorphous selenium, tellurium, selenium-tellurium alloys, cadmium sulfide, antimony sulfide, zinc oxide and zinc sulfide. In embodiments, cyclocondensed aromatic pigments, perylene pigments and azo pigments may be used to impart sensitivity, electric stability and photochemical stability against irradiated light. These charge generation substances may be used either alone or as a combination of two or more.

In embodiments, the charge generation layer 13 may be formed by vacuum deposition of the charge generation substance or application of a coating solution in which the charge generation substance is dispersed in an organic solvent containing a binding resin. The binding resins used in the charge generation layer of embodiments include polyvinyl acetal resins such as polyvinyl butyral resins, polyvinyl formal resins or partially acetalized polyvinyl acetal resins in which butyral is partially modified with formal or acetoacetal, polyamide resins, polyester resins, modified ether type polyester resins, polycarbonate resins, acrylic resins, polyvinyl chloride resins, polyvinylidene chlorides, polystyrene resins, polyvinyl acetate resins, vinyl chloride-vinyl acetate copolymers, silicone resins, phenol resins, phenoxy resins, melamine resins, benzoguanamine resins, urea resins, polyurethane resins, poly-N-vinylcarbazole resins, polyvinylanthracene resins, polyvinylpyrene resins and mixtures thereof. In embodiments in which one or more of polyvinyl acetal resins, vinyl chloride-vinyl acetate copolymers, phenoxy resins or modified ether type polyester resins are used, the dispersibility of the charge generation substance may be improved to cause no occurrence of coagulation of the charge generation substance, and a coating solution that is stable for a long period of time may be obtained. The use of such a coating solution in embodiments makes it possible to form a uniform coating easily and surely. As a result, the electric characteristics may be improved, and image defects may be prevented. Further, the compounding ratio of the charge generation substance to the binding resin may be, in embodiments, within the range of 5:1 to 1:2 by volume ratio.

Further, the solvents used in preparing the coating solution in embodiments may include organic solvents such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride, chloroform and mixtures thereof.

Methods for applying the coating solution in embodiments include the coating methods described above with reference to the underlayer. The thickness of the charge generation layer 13 thus formed may be from 0.01 to 5 μm, and from 0.1 to 2 μm. When the thickness of the charge generation layer 13 is less than 0.01 μm, it becomes difficult to uniformly form the charge generation layer. On the other hand, when the thickness exceeds 5 μm, the electrophotographic characteristics tend to significantly deteriorate.

Further, a stabilizer such as an antioxidant or an inactivating agent can also be added to the charge generation layer 13 in embodiments. Non-limiting examples of antioxidants that may be used include but are not limited to the siloxane-containing antioxidants described above and conventional antioxidants such as phenolic, sulfur, phosphorus and amine compounds. Inactivating agents that may be used in embodiments may include bis(dithiobenzyl)nickel and nickel di-n-butylthiocarbamate.

In embodiments, the charge transfer layer 14 can be formed by applying a coating solution containing the charge transfer substance and a binding resin, and further fine particles, an additive, etc., as described above.

Low molecular-weight charge-transfer substances that may be used in embodiments may include, for example, pyrene, carbazole, hydrazone, oxazole, oxadiazole, pyrazoline, arylamine, arylmethane, benzidine, thiazole, stilbene and butadiene compounds. In embodiments, high molecular-weight charge-transfer substances may be used and include, for example, poly-N-vinylcarbazoles, poly-N-vinylcarbazole halides, polyvinyl pyrenes, polyvinylanthracenes, polyvinylacridines, pyrene-formaldehyde resins, ethylcarbazole-formaldehyde resins, triphenylmethane polymers and polysilanes. Triphenylamine compounds, triphenylmethane compounds and benzidine compounds may be used in embodiments to promote mobility, stability and transparency to light. Further, silicon-containing compounds represented by general formula (1) can also be used as charge transfer substances in particular embodiments.

As binding resins in embodiments, high molecular-weight polymers that can form an electrical insulating film may be used. For example, when polyvinyl acetal resins, polyamide resins, cellulose resins, phenol resins, etc., which are soluble in alcoholic solvents, are used, binding resins used together with these resins include polycarbonates, polyesters, methacrylic resins, acrylic resins, polyvinyl chlorides, polyvinylidene chlorides, polystyrenes, polyvinyl acetates, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazoles, polyvinyl butyrals, polyvinyl formals, polysulfones, casein, gelatin, polyvinyl alcohols, phenol resins, polyamides, carboxymethyl celluloses, vinylidene chloride-based polymer latexes and polyurethanes. Of the above-mentioned high molecular-weight polymers, polycarbonates, polyesters, methacrylic resins and acrylic resins have excellent compatibility with the charge transfer substance, solubility and strength.

The charge transfer layer 14 of embodiments may further contain an additive such as a plasticizer, a surface modifier, an antioxidant or an agent for preventing deterioration by light.

The thickness of the charge transfer layer 14 may be, in embodiments, from 5 to 50 μm, or from 10 to 40 μm. When the thickness of the charge transfer layer is less than 5 μm, charging becomes difficult. However, thicknesses exceeding 50 μm result significant deterioration of the electrophotographic characteristics.

Protective layer 15 may contain, in embodiments, resins soluble in liquid components in coating solution used for formation of protective layers, silicon-containing compounds and siloxane-containing antioxidants as described above. Protective layer 15 may further contain a lubricant or fine particles of silicone oil or a fluorine material, which can also improve lubricity and strength. Non-limiting examples of the lubricants include the above-mentioned fluorine-based silane coupling agents. Fine particles to be dispersed in the protective layer 15 of embodiments may include fine particles comprising resins obtained by copolymerizing fluororesins with hydroxyl group-containing monomers, as described in Proceedings of Lectures in the Eighth Polymer Material Forum, page 89, and semiconductive metal oxides, as well as the above-mentioned fine silicone particles and fine fluorine-based particles. The thickness of the protective layer is may be, in embodiments, from 0.1 to 10 μm, or from 0.5 to 7 μm.

The electrophotographic photoreceptor of embodiments should not be construed as being limited to the above-mentioned constitution. For example, the electrophotographic photoreceptor shown in FIG. 1 is provided with the protective layer 15. When the charge transfer layer 14 contains the resin soluble in the liquid component in the coating solution used for formation of this layer, as well as silicon-containing compounds and siloxane-containing antioxidants, the charge transfer layer 14 may be used as a top surface layer (a layer on the side farthest apart from the support 11) without using the protective layer 15. In this case, the charge transfer substance contained in the charge transfer layer 14 may be soluble in the liquid component in the coating solution used for formation of the charge transfer layer 14.

Image Forming Apparatus and Process Cartridge

Figure 2:
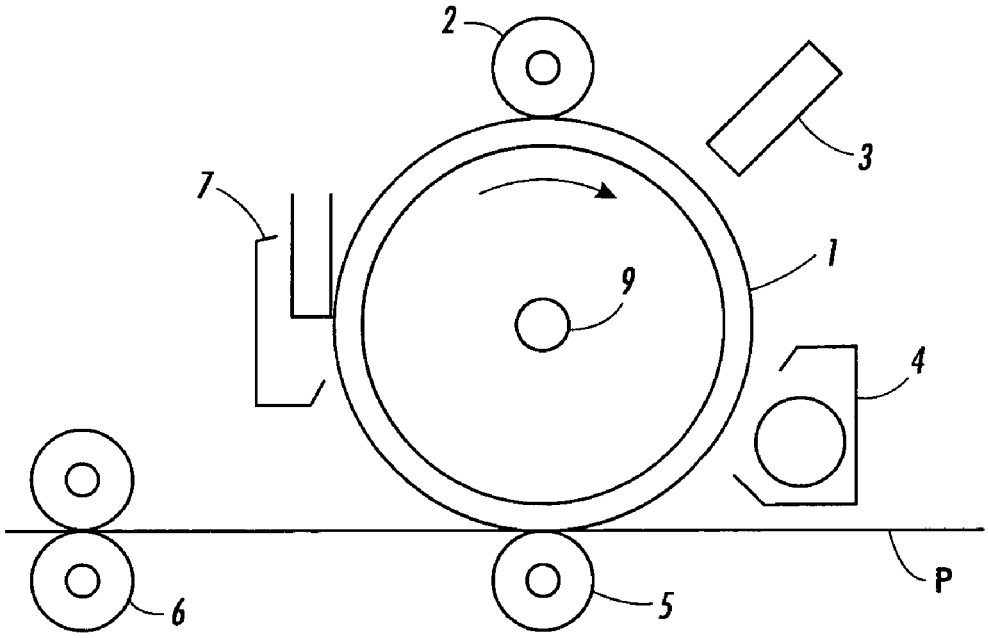
FIG. 2 is a schematic view showing a preferred embodiment of an image forming apparatus.

FIG. 2 is a schematic view showing an embodiment of an image forming apparatus. In the apparatus shown in FIG. 2, the electrophotographic photoreceptor 1 constituted as shown in FIG. 1 is supported by a support 9, and rotatable at a specified rotational speed in the direction indicated by the arrow, centered on the support 9. A contact charging device 2, an exposure device 3, a developing device 4, a transfer device 5 and a cleaning unit 7 are arranged in this order along the rotational direction of the electrophotographic photoreceptor 1. Further, this exemplary apparatus is equipped with an image fixing device 6, and a medium P to which a toner image is to be transferred is conveyed to the image fixing device 6 through the transfer device 5.

The contact charging device 2 has a roller-shaped contact charging member. The contact charging member is arranged so that it comes into contact with a surface of the photoreceptor 1, and a voltage is applied, thereby being able to give a specified potential to the surface of the photoreceptor 1. In embodiments, a contact charging member may be formed from a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber. Non-limiting examples of metal oxides that may be used in embodiments include ZnO, $SnO_2$, $TiO_2$, $In_2O_3$, $MoO_3$ and complex oxides thereof. Further, a perchlorate may be added to the elastomer material to impart conductivity.

Further, a covering layer can also be provided on a surface of the contact charging member of embodiments. Non-limiting examples of materials that may be used in embodiments for forming a covering layer include N-alkoxy-methylated nylon, cellulose resins, vinylpyridine resins, phenol resins, polyurethanes, polyvinyl butyrals, melamines and mixtures thereof. Furthermore, emulsion resin materials such as acrylic resin emulsions, polyester resin emulsions or polyurethanes, may be used. In order to further adjust resistivity, conductive agent particles may be dispersed in these resins, and in order to prevent deterioration, an antioxidant can also be added thereto. Further, in order to improve film forming properties in forming the covering layer, a leveling agent or a surfactant may be added to the emulsion resin in embodiments.

The resistance of the contact charging member of embodiments may be from $10^0$ to $10^{14}$ Ωcm, and from $10^2$ to $10^{12}$ Ωcm. When a voltage is applied to this contact charging member, either a DC voltage or an AC voltage can be used as the applied voltage. Further, a superimposed voltage of a DC voltage and an AC voltage can also be used.

In the exemplary apparatus shown in FIG. 2, the contact charging member of the contact charging device 2 is in the shape of a roller. However, such a contact charging member may be in the shape of a blade, a belt, a brush or the like.

Further, in embodiments an optical device that can perform desired imagewise exposure to a surface of the electrophotographic photoreceptor 1 with a light source such as a semiconductor laser, an LED (light emitting diode) or a liquid crystal shutter, may be used as the exposure device 3.

Furthermore, a known developing device using a normal or reversal developing agent of a one-component system, a two-component system or the like may be used in embodiments as the developing device 4. There is no particular limitation on toners that may be used in embodiments.

Contact type transfer charging devices using a belt, a roller, a film, a rubber blade or the like, or a scorotron transfer charger or a corotron transfer charger utilizing corona discharge may be employed as the transfer device 5, in various embodiments.

Further, in embodiments, the cleaning device 7 may be a device for removing a remaining toner adhered to the surface of the electrophotographic photoreceptor 1 after a transfer step, and the electrophotographic photoreceptor 1 repeatedly subjected to the above-mentioned image formation process may be cleaned thereby. In embodiments, the cleaning device 7 may be a cleaning blade, a cleaning brush, a cleaning roll or the like. Materials for the cleaning blade include urethane rubber, neoprene rubber and silicone rubber.

In the exemplary image forming device shown in FIG. 2, the respective steps of charging, exposure, development, transfer and cleaning are conducted in turn in the rotation step of the electrophotographic photoreceptor 1, thereby repeatedly performing image formation. The electrophotographic photoreceptor 1 may be provided with specified silicon-containing layers and photosensitive layers that satisfy equation (1), as described above, and thus photoreceptors having excellent discharge gas resistance, mechanical strength, scratch resistance, particle dispersibility, etc., may be provided. Accordingly, even in embodiments in which the photoreceptor is used together with the contact charging device or the cleaning blade, or further with spherical toner obtained by chemical polymerization, good image quality can be obtained without the occurrence of image defects such as fogging. That is, embodiments provide image forming apparatuses that can stably provide good image quality for a long period of time is realized.

Figure 3:
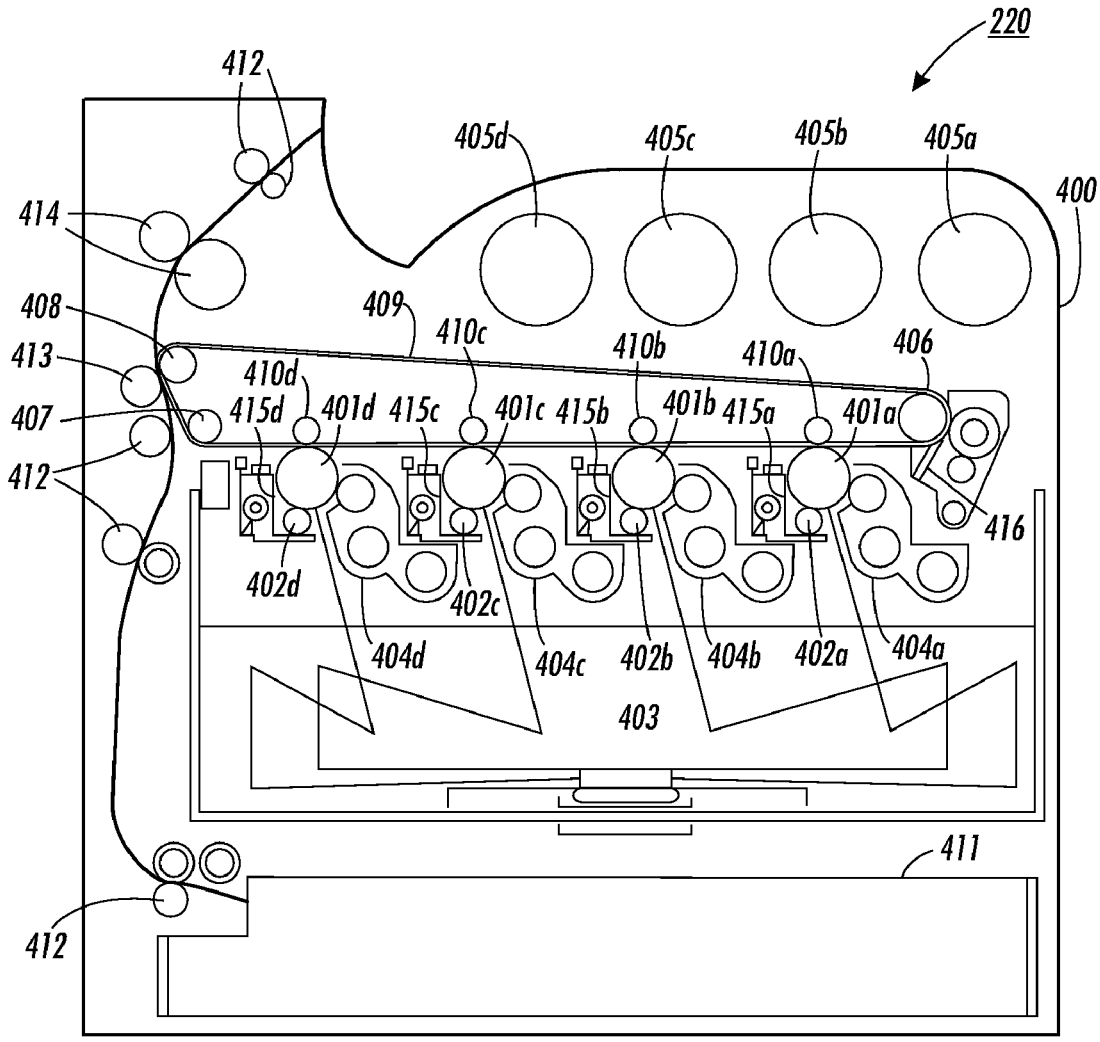
FIG. 3 is a schematic view showing another preferred embodiment of an image forming apparatus.

FIG. 3 is a cross sectional view showing another exemplary embodiment of an image forming apparatus. The image forming apparatus 220 shown in FIG. 3 is an image forming apparatus of an intermediate transfer system, and four electrophotographic photoreceptors 401*a* to 401*d* are arranged in parallel with each other along an intermediate transfer belt 409 in a housing 400.

Here, the electrophotographic photoreceptors 401*a* to 401*d* carried by the image forming apparatus 220 are each the electrophotographic photoreceptors of embodiments. Each of the electrophotographic photoreceptors 401*a* to 401*d* may rotate in a predetermined direction (counterclockwise on the sheet of FIG. 3), and charging rolls 402*a* to 402*d*, developing device 404*a* to 404*d*, primary transfer rolls 410*a* to 410*d* and cleaning blades 415*a* to 415*d* are each arranged along the rotational direction thereof. In each of the developing device 404*a* to 404*d*, four-color toners of yellow (Y), magenta (M), cyan (C) and black (B) contained in toner cartridges 405*a* to 405*d* can be supplied, and the primary transfer rolls 410*a* to 410*d* are each brought into abutting contact with the electrophotographic photoreceptors 401*a* to 401*d* through an intermediate transfer belt 409.

Further, a laser light source (exposure unit) 403 is arranged at a specified position in the housing 400, and it is possible to irradiate surfaces of the electrophotographic photoreceptors 401*a* to 401*d* after charging with laser light emitted from the laser light source 403. This performs the respective steps of charging, exposure, development, primary transfer and cleaning in turn in the rotation step of the electrophotographic photoreceptors 401*a* to 401*d*, and toner images of the respective colors are transferred onto the intermediate transfer belt 409, one over the other.

The intermediate transfer belt 409 is supported with a driving roll 406, a backup roll 408 and a tension roll 407 at a specified tension, and rotatable by the rotation of these rolls without the occurrence of deflection. Further, a secondary transfer roll 413 is arranged so that it is brought into abutting contact with the backup roll 408 through the intermediate transfer belt 409. The intermediate transfer belt 409 which has passed between the backup roll 408 and the secondary transfer roll 413 is cleaned up by a cleaning blade 416, and then repeatedly subjected to the subsequent image formation process.

Further, a tray 411, for providing a medium such as paper to which a toner image is to be transferred, is provided at a specified position in the housing 400. The medium to which the toner image is to be transferred in the tray 411 is conveyed in turn between the intermediate transfer belt 409 and the secondary transfer roll 413, and further between two fixing rolls 414 brought into abutting contact with each other, with a conveying roll 412, and then delivered out of the housing 400.

According to the exemplary image forming apparatus 220 shown in FIG. 3, the use of electrophotographic photoreceptors of embodiments as electrophotographic photoreceptors 401*a* to 401*d* may achieve discharge gas resistance, mechanical strength, scratch resistance, etc. on a sufficiently high level in the image formation process of each of the electrophotographic photoreceptors 401*a* to 401*d*. Accordingly, even when the photoreceptors are used together with the contact charging devices or the cleaning blades, or further with the spherical toner obtained by chemical polymerization, good image quality can be obtained without the occurrence of image defects such as fogging. Therefore, also according to the image forming apparatus for color image formation using the intermediate transfer body, such as this embodiment, the image forming apparatus which can stably provide good image quality for a long period of time is realized.

The above-mentioned embodiments should not be construed as limiting. For example, each apparatus shown in FIG. 2 or 3 may be equipped with a process cartridge comprising the electrophotographic photoreceptor 1 (or the electrophotographic photoreceptors 401*a* to 401*d*) and charging device 2 (or the charging devices 402*a* to 402*d*). The use of such a process cartridge allows maintenance to be performed more simply and easily.

Further, in embodiments, when a charging device of the non-contact charging system such as a corotron charger is used in place of the contact charging device 2 (or the contact charging devices 402*a* to 402*d*), sufficiently good image quality can be obtained.

Furthermore, in the embodiment of an apparatus that is shown in FIG. 2, a toner image formed on the surface of the electrophotographic photoreceptor 1 is directly transferred to the medium P to which the toner image is to be transferred. However, the image forming apparatus of embodiments may be further provided with an intermediate transfer body. This makes it possible to transfer the toner image from the intermediate transfer body to the medium P to which the toner image is to be transferred, after the toner image on the surface of the electrophotographic photoreceptor 1 has been transferred to the intermediate transfer body. As such an intermediate transfer body, there can be used one having a structure in which an elastic layer containing a rubber, an elastomer, a resin or the like and at least one covering layer are laminated on a conductive support.

In addition, the image forming apparatus of embodiments may be further equipped with a static eliminator such as an erase light irradiation device. This may prevent incorporation of residual potential into subsequent cycles when the electrophotographic photoreceptor is used repeatedly. Accordingly, image quality can be more improved.

EXAMPLES

The embodiments as discussed above are illustrated in greater detail with reference to the following Examples and Comparative Examples, but the invention should not be construed as being limited thereto. In the following examples and comparative examples, all the "parts" are given by weight unless otherwise indicated.

Further, the compounds shown in Tables 1 to 3 are indicated with reference to the compound number in Tables 1 to 3 or the formula number.

Examples 1 & 2

Synthesis of Siloxane-Containing Antioxidant

Compound III-2 was prepared according to the following method.

100 g of 3-(4-hydroxy-3,5-di-t-butylphenyl)propanoic acid was treated with 35.2 g of potassium isopropoxide (1.0 equivalents, as a 20% by weight solution in isopropanol) at room temperature for 30 minutes, after which the solvent was removed under reduced pressure. The residue was dissolved in 400 ml of DMF and 130.5 g of 3-iodopropylmethyldiisopropoxysilane (1.1 equivalents) was added. The reaction was heated at 80° C. for two hours. The reaction mixture was then cooled, placed in dichloromethane and extracted with a brine solution. The organic layer was collected, dried and the solvent removed under reduced pressure. The compound was purified by vacuum distillation to produce was a yellowish oil, in a yield of 85%. $^1$H NMR ($CDCl_3$) was used to determine the composition of the material as compound III-2, with a purity of more than 98%.

Preparation of Electrophotographic Photoreceptor

A coating solution for an underlayer comprising 100 parts of a zirconium compound (trade name: ORGATICS ZC540, manufactured by Matsumoto Chemical Industry Co., Ltd.), 10 parts of a silane compound (trade name: A110, manufactured by Nippon Unicar Co., Ltd.), 400 parts of isopropanol and 200 parts of butanol was prepared. This coating solution was applied onto a cylindrical A1 substrate subjected to honing treatment by dip coating, and dried by heating at 150° C. for 10 minutes to form an underlayer having a film thickness of 0.1 μm.

Then, as a charge generation substance, 10 parts of chlorogallium phthalocyanine crystals having strong diffraction peaks at Bragg angles (2θ±0.2°) of 7.4°, 16.6°, 25.5° and 28.3° in an X-ray diffraction spectrum was mixed with 10 parts of a polyvinyl butyral resin (trade name: S-LEC BM-S, manufactured by Sekisui Chemical Co., Ltd.) and 1,000 parts of butyl acetate, and the resulting mixture was dispersed by treating it together with glass beads in a paint shaker for one hour to obtain a coating solution for a charge generation layer. This coating solution was applied onto the above-mentioned underlayer by dip coating, and dried by heating at 100° C. for 10 minutes to form the charge generation layer having a film thickness of about 0.15 μm.

Further, 20 parts of a benzidine compound represented by the following structural formula (19), 30 parts of a bisphenol (z)polycarbonate resin (viscosity average molecular weight: $4.4\times10^4$), 5 parts of 3-(3,3,3-trifluoropropyl)methylcyclotrisiloxane, 150 parts of monochlorobenzene and 150 parts of tetrahydrofuran were mixed to obtain a coating solution for a charge transfer layer. This coating solution was applied onto the above-mentioned charge generation layer by dip coating, and dried by heating at 115° C. for one hour to form the charge generation layer having a film thickness of 20 μm.

(19)

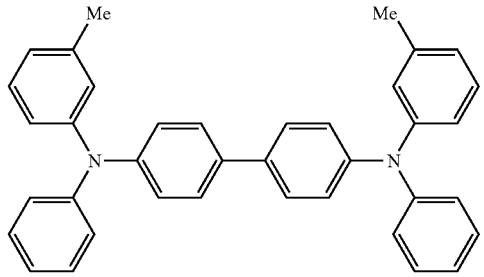

Further, 2.75 parts of compound II-2, 1.5 parts of compound I-3, 0.25 parts of 1-(dimethoxymethylsilyl)-1H,2H,2H-perfluorononane, 1 part of hexamethylcyclotrisilane, 0.261 parts of compound III-2, a siloxane-containing hindered phenol antioxidant, and 2.75 parts of methanol were mixed, and 0.275 parts of an ion exchange resin (AMBERLIST H15) was added thereto, followed by stirring for 3 hours. Furthermore, 8 parts of butanol and 1.23 parts of distilled water were added to this mixture, followed by stirring at room temperature for 30 minutes. Then, the resulting mixture was filtered to remove the ion exchange resin, and 0.045 parts of aluminum trisacetylacetonate ($Al(AcAC)_3$), 0.045 parts of acetylacetone (AcAc), 0.5 parts of a polyvinyl butyral resin (trade name: S-LEC KW-1, manufactured by Sekisui Chemical Co., Ltd.), and 0.045 parts of butylated-hydroxytoluene (BHT) were added to a filtrate obtained, and thoroughly dissolved therein for 2 hours to obtain a coating solution for a protective layer. This coating solution was applied onto the above-mentioned charge transfer layer by dip coating (coating speed: about 170 mm/min), and dried by heating at 130° C. for one hour to form the protective layer having a film thickness of 3 μm, thereby obtaining a desired electrophotographic photoreceptor.

Comparative Examples 1 to 4

In each of Comparative Examples 1 to 4, an underlayer, a charge generation layer and a charge transfer layer were formed in the same manner as with Examples 1 and 2.

Then, a coating solution for formation of a protective layer was prepared in the same manner as with Example 1 with the exception that the kinds and amounts of antioxidant included were changed. As shown in Table 4, Comparative Examples 1 and 2 contain 3-thiopropyl methyl dimethoxysilane a standard antioxidant. Comparative Examples 3 and 4 were prepared without inclusion of an antioxidant in the silicon-containing layer. Further, butanol was added to the coating solution to adjust the viscosity so as to give a coating speed of about 170 mm/min in dip coating. The coating solution adjusted in viscosity was applied onto the charge transfer layer (coating speed: about 170 mm/min), and dried by heating at 130° C. for one hour to form the protective layer having a film thickness of 3 μm, thereby obtaining a desired electrophotographic photoreceptor.

Table 4 summarizes the preparation of Examples 1 and 2 and Comparative Examples 1 to 4.

TABLE 4

| Materials | Examples 1 & 2 | Comparative Examples 1 & 2 | Comparative Examples 3 & 4 |
|---|---|---|---|
| | Exchange | | |
| Compound II-2 (g) | 2.75 | 2.75 | 11 |
| Compound I-3 (g) | 1.5 | 1.5 | 6 |
| 1-(dimethoxymethylsilyl)-1H,2H,2H-perfluorononane (g) | | | |
| hexamethylcyclotrisilane (g) | 0.25 | 0.25 | 1 |
| Compound III-2 (g) | 0.098 | | |
| 3-thiopropyl methyl dimethoxysilane | | 0.045 | |
| MeOH (g) | 2.75 | 2.75 | 11 |
| AMBERLYST H15 | 0.275 | 0.275 | 1.1 |
| Time—3 hours | | | |
| nBuOH (g) | 8 | 8 | 32 |
| $H_20$ (2 eq) | 1.23 | 1.23 | 4.92 |
| Reaction Time—0.5 hours | | | |
| $Al(AcAc)_3$ (g) | 0.045 | 0.045 | 0.18 |
| AcAc (g) | 0.045 | 0.045 | 0.18 |
| BXL (g) | 0.5 | 0.5 | 2 |
| BHT (g) | | | 0.18 |
| Dissolution Time—1 hour | | | |
| Solid Content | 18 | | |
| Concentration | 27.09 | | |
| Total (g) | 66.5 | | |

The thicknesses of the outermost layer of the photoreceptors of Examples 1 and 2 and Comparative Examples 1 to 4 are shown in Table 5, along with the thicknesses of the outermost layers before print testing.

TABLE 5

| | Outermost Layer Thickness (μm) |
|---|---|
| Example 1 | 2.7 |
| Example 2 | 2.5 |
| Comparative Example 1 | 3.0 |
| Comparative Example 2 | 3.1 |
| Comparative Example 3 | 2.4 |
| Comparative Example 4 | 2.7 |

Figure 4:
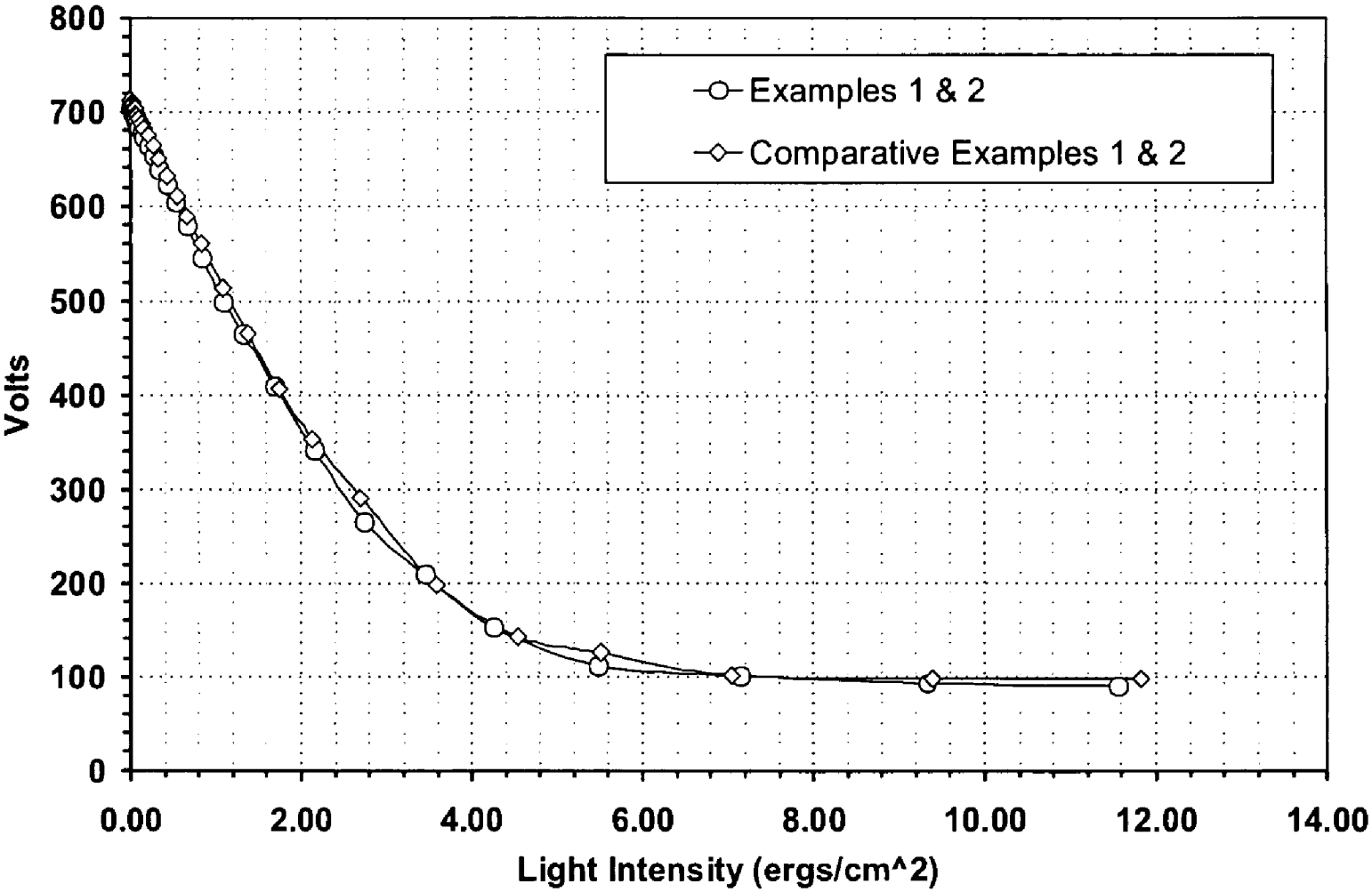
FIG. 4 is a graphical representation of the electrical performance of photoreceptors of exemplary embodiments.

The electrical performance of each photoreceptor was tested, and no significant difference between the photoreceptors of Examples 1 and 2 and Comparative Examples 1 to 4 was found, as shown in FIG. 4.

Figure 5:
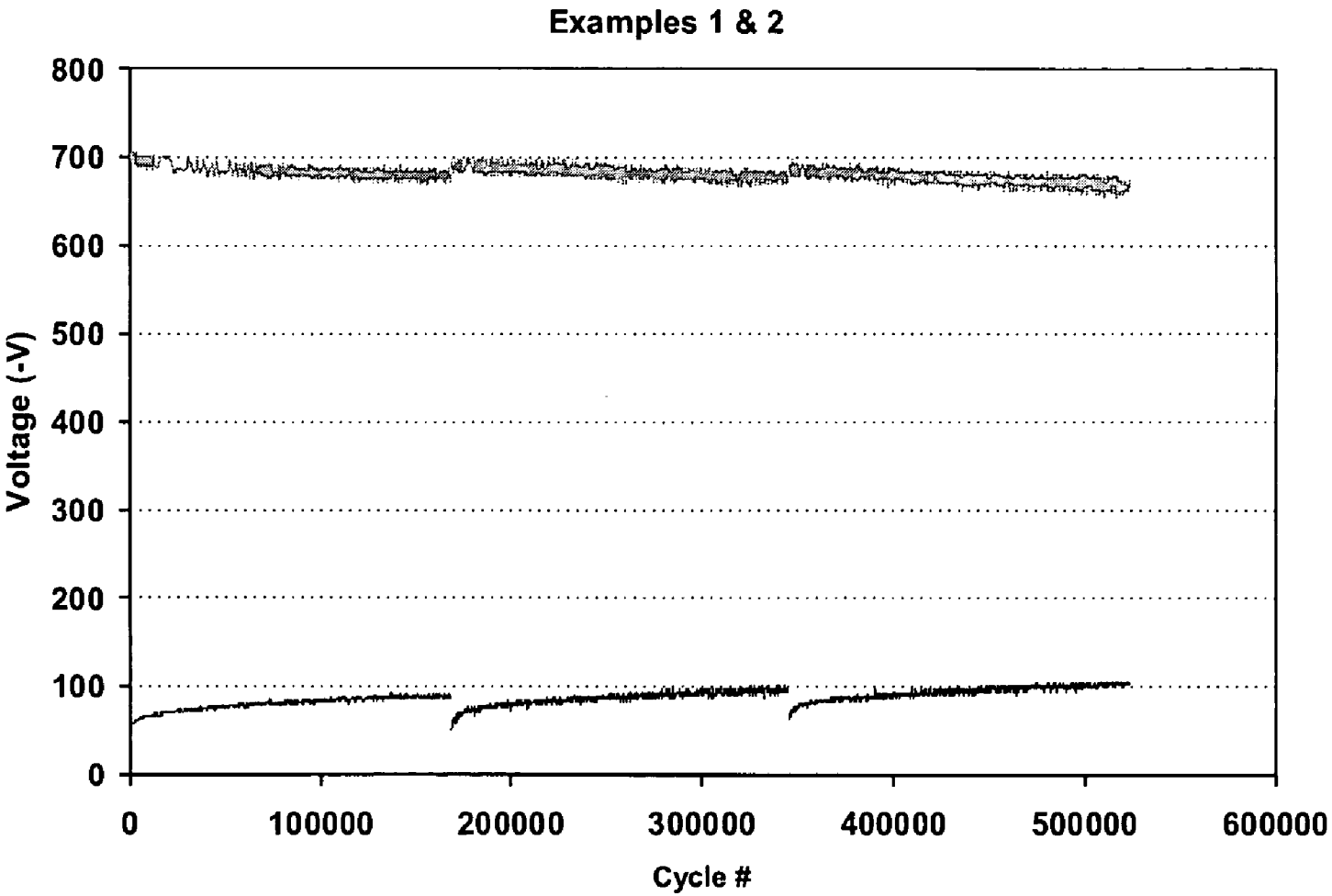
FIG. 5 is a graphical representation of the performance of a photoreceptor of an exemplary embodiment in a high temperature, high humidity environment.

In addition, the photoreceptors of Examples 1 and 2 and Comparative Examples 1 to 4 were cycled by repeatedly charging and discharging the photoreceptor under conditions of high temperature and high humidity (30° C. and 85% relative humidity) in the absence of paper. FIG. 5 is an exemplary summary graph showing voltage versus cycle number for Example 1. As evident from FIG. 5, both low potential (Vr), shown as the lower line in the summary graph, and high potential (Vhigh), shown as the upper line in the summary graph, remain fairly constant over long term cycling.

Print Test

Immediately after electrical cycling, the electrophotographic photoreceptors of each of Examples 1 and 2 and Comparative Examples 1 to 4 were placed in a xerographic customer replacable unit (CRU), as is used in a DOCUCOLOR 1632 (manufactured by Xerox Corporation) and placed in such a machine for print testing.

Figure 6A:
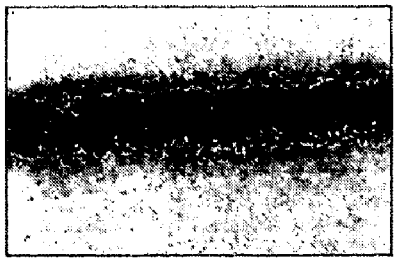
FIGS. 6(*a*)-8(*b*) are image-captures of standard test print images printed under conditions of high humidity and high temperature for photoreceptors of exemplary embodiments and for conventional photoreceptors.
Figure 6B:
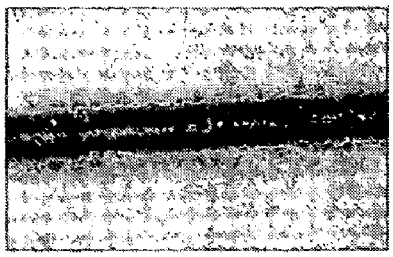
Figure 6C:
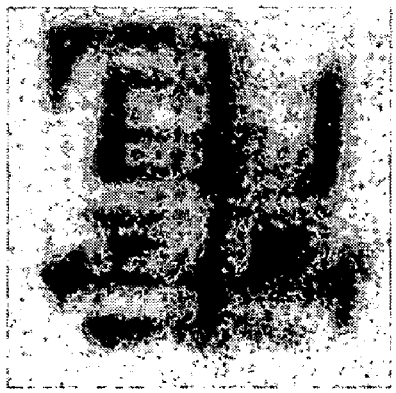
Figure 7A:
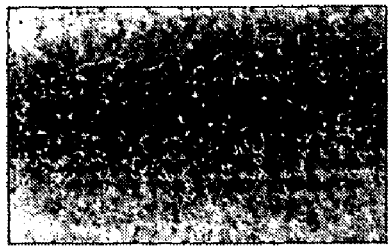
Figure 7B:
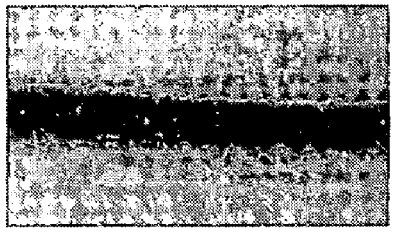
Figure 7C:
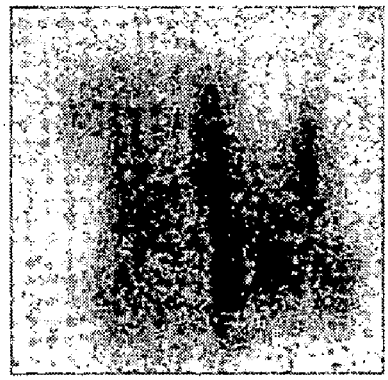
Figure 8A:
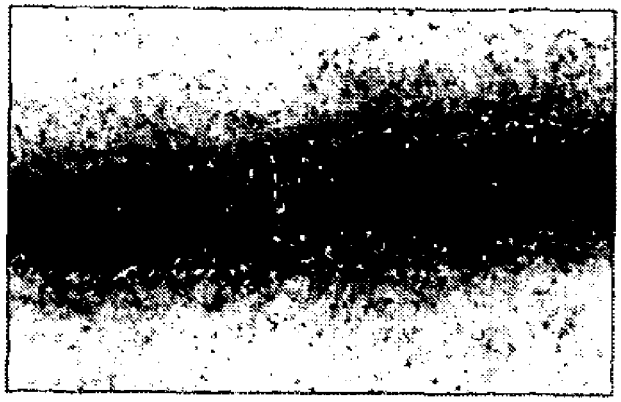
Figure 8B:
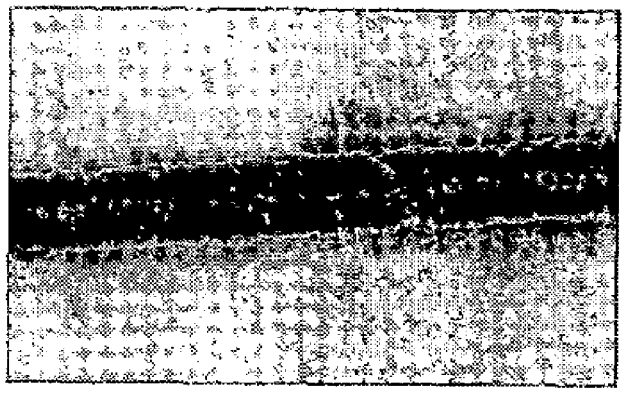

Then, print tests were carried out on each photoreceptor. The tests were carried out under the same conditions of high temperature and high humidity (30° C. and 85% relative humidity), and the initial image quality and surface state of the electrophotographic photoreceptors and the image quality and surface state of the electrophotographic photoreceptors after 25 prints were determined. FIGS. 6*a*, 6*b*, 7*a*, 7*b*, 8*a* and 8*b* are image captures of the 2/2 lines of standard test prints for Example 1, Comparative Example 1 and Comparative Example 3, respectively. As shown in FIGS. 6*a*, 7*a* and 8*a*, the page 1 print image for Comparative Examples 1 and 3 show a "washed out" 2/2 line, while the page 1 print image for Example 1 shows a clearer 2/2 line. However, after 25 pages, the 2/2 line image is resolved in FIGS. 6*b*, 7*b* and 8*b*, corresponding to Example 1 and Comparative Examples 1 and 3, respectively. As can be seen from FIGS. 6*c* and 7*c*, which correspond to an 8 point Kanji character print after 25 pages, Example 1, which includes compound III-2 as the antioxidant, provides markedly improved character resolution when compared to Comparative Example 1, which includes a standard antioxidant.

As described above, according to embodiments, there can be provided the electrophotographic photoreceptor that is sufficiently high in stain resistance against a developing agent, a discharge product, etc. and in durability against a contact charger, a cleaning blade, etc., and further, which can prevent the occurrence of coating defects in the production thereof, and the process cartridge and the image forming apparatus which can provide good image quality for a long period of time.

While embodiments have been described in detail above, it will be apparent to one skilled in the art that various changes and modifications can be made therein without departing from the spirit and scope thereof.

What is claimed is:

1. An electrophotographic photoreceptor comprising a silicon layer, wherein the silicon-containing layer comprises:

one or more siloxane-containing compound; and one or more siloxane-containing antioxidant;

wherein the siloxane-containing antioxidant is at least one member selected from the group consisting of siloxane-containing antioxidants represented by the formula

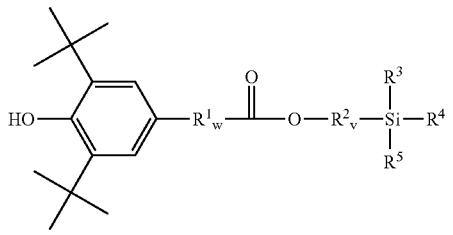

wherein $R^1$ and $R^2$ each represent a substituted or unsubstituted divalent hydrocarbon group, w and v are each an integer from 0 to 10, and $R^3$, $R^4$ and $R^5$ each represent a member selected from the group consisting of hydrogen atoms, alkyl groups having 1 to 4 carbon atoms and alkoxyl groups having 1 to 4 carbon atoms, and at least one of $R^3$, $R^4$ and $R^5$ represents an alkoxyl group.

2. The electrophotographic photoreceptor of claim 1, wherein the at least one siloxane-containing compound includes at least one siloxane-containing hole transport molecule and at least one siloxane-containing binder material.

3. The electrophotographic photoreceptor of claim 1, wherein the siloxane-containing hole transport molecule is member selected from the group consisting of:

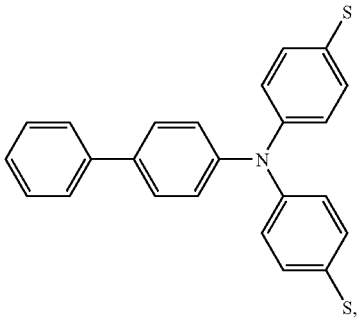

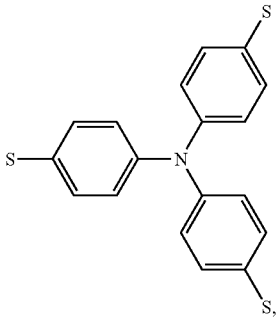

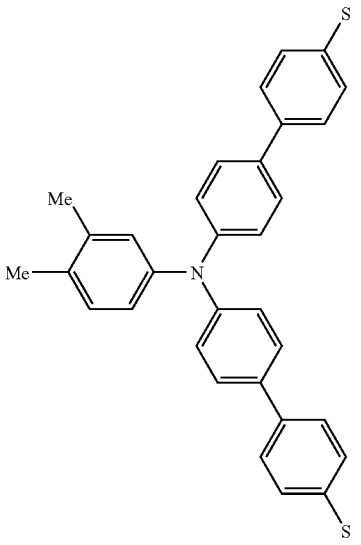

and

-continued

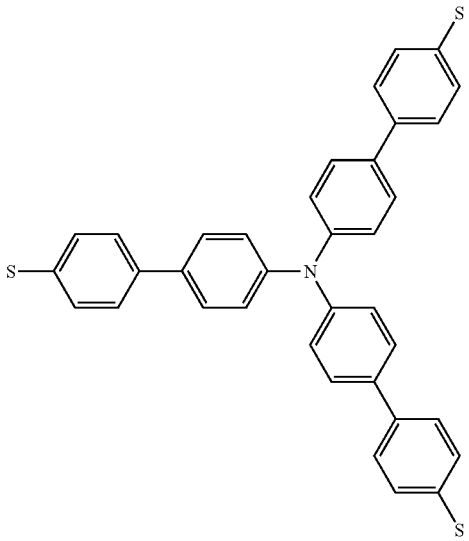

wherein S is at least one member selected from the group consisting of: $—(CH_2)_2—COO—(CH_2)_3—Si(O^iPr)_3$, $—(CH_2)_2—COO—(CH_2)_3—SiMe(O^iPr)_2$, $—(CH_2)_2—COO—(CH_2)_3—SiMe_2(O^iPr)$ and $—COO—(CH_2)_3—Si(O^iPr)_3$.

4. The electrophotographic photoreceptor of claim 1, wherein the siloxane-containing antioxidant is at least one member selected from the group consisting of hindered phenol antioxidants.

5. The electrophotographic photoreceptor of claim 1, wherein the antioxidant is at least partially located in a siloxane-containing region of the silicon layer.

6. An electrophotographic imaging apparatus comprising an electrophotographic photoreceptor which comprises a silicon layer, wherein the silicon layer comprises:

one or more siloxane-containing compound; and one or more siloxane-containing antioxidant;

wherein the siloxane-containing antioxidant is at least one member selected from the group consisting of siloxane-containing antioxidants represented by the formula

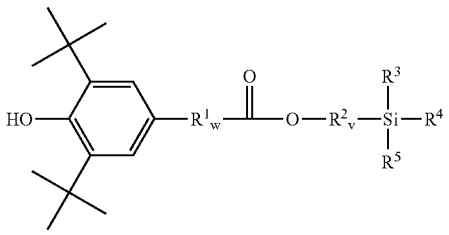

wherein $R^1$ and $R^2$ each represent a substituted or unsubstituted divalent hydrocarbon group, w and v are each an integer from 0 to 10, and $R^3$, $R^4$ and $R^5$ each represent a member selected from the group consisting of hydrogen atoms, alkyl groups having 1 to 4 carbon atoms and alkoxyl groups having 1 to 4 carbon atoms, and at least one of $R^3$, $R^4$ and $R^5$ represents an alkoxyl group.

7. The electrophotographic imaging apparatus of claim 6, wherein the at least one siloxane-containing compound includes at least one siloxane-containing hole transport molecule and at least one siloxane-containing binder material.

8. The electrophotographic imaging apparatus of claim 6, wherein the siloxane-containing hole transport molecule is at least one member selected from the group consisting of:

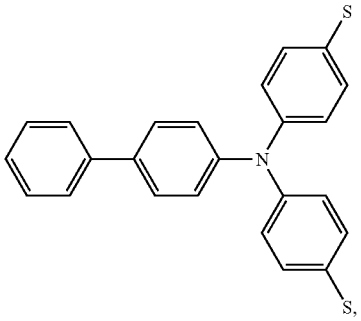

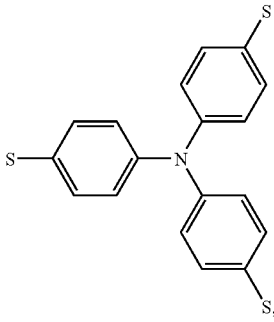

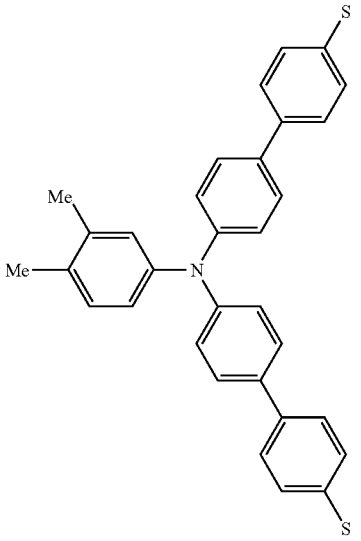

and

-continued

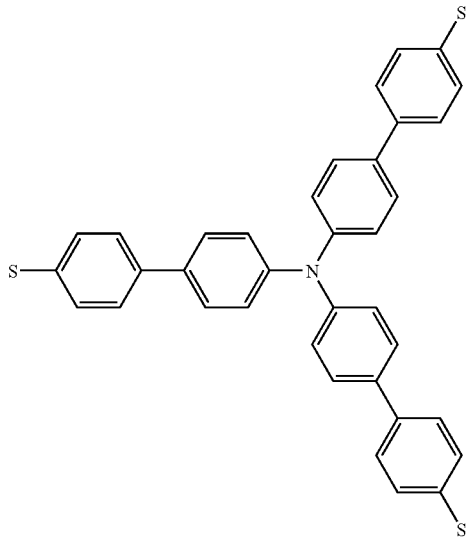

wherein S is at least one member selected from the group consisting of: $—(CH_2)_2—COO—(CH_2)_3—Si(O^iPr)_3$, $—(CH_2)_2—COO—(CH_2)_3—SiMe(O^iPr)_2$, $—(CH_2)_2—COO—(CH_2)_3—SiMe_2(O^iPr)$ and $—COO—(CH_2)_3—Si(O^iPr)_3$.

9. The electrophotographic imaging apparatus of claim 6, wherein the siloxane-containing antioxidant is at least one member selected from the group consisting of hindered phenol antioxidants.

10. A method of producing an electrophotographic photoreceptor comprising:

providing a substrate;

forming an underlayer;

forming a charge generation layer over the underlayer;

forming a charge transfer layer over the charge generation layer; and forming a protective layer over the charge transfer layer;

wherein, the protective layer comprises a compound of formula III-2

III-2

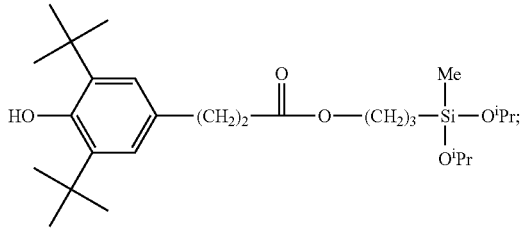

wherein the compound of formula III-2 is prepared by treating 3-(4-hydroxy-3,5-di-t-butylphenyl)propanoic acid with potassium isopropoxide at room temperature;

removing solvent under reduced pressure to provide a residue;

dissolving the residue in DMF;

adding 3-iodopropylmethyldiisopropoxysilane to form a reaction mixture;

heating the reaction mixture to 80° C. for two hours;

cooling the reaction mixture;

adding the reaction mixture to dichloromethane;

extracting a product with a brine solution; and purifying the product.

* * * * *